US006295772B1

(12) United States Patent
Whitson

(10) Patent No.: US 6,295,772 B1
(45) Date of Patent: Oct. 2, 2001

(54) MODULAR MASONRY STEP AND DECK ASSEMBLY

(75) Inventor: Robert L. Whitson, West Bend, WI (US)

(73) Assignee: Bend Industries, Inc., West Bend, WI (US)

( * ) Notice: Subject to any disclaimer, the term of this patent is extended or adjusted under 35 U.S.C. 154(b) by 0 days.

(21) Appl. No.: 09/303,215

(22) Filed: Apr. 30, 1999

Related U.S. Application Data

(60) Provisional application No. 60/083,671, filed on Apr. 30, 1998.

(51) Int. Cl.[7] ..... E04F 11/00

(52) U.S. Cl. ..... 52/182; D25/118

(58) Field of Search ..... 52/182, 183, 184, 52/185, 186, 187, 188, 189, 190, 191, 604, 605, 596, 578; D25/118, 113

(56) References Cited

U.S. PATENT DOCUMENTS

| | | | | |
|---|---|---|---|---|
| 2,190,446 | * | 2/1940 | Fioritto | 52/182 |
| 2,204,583 | * | 6/1940 | Falls . | |
| 2,289,439 | * | 7/1942 | Kogl . | |
| 2,351,768 | * | 6/1944 | Kaping . | |
| 2,374,905 | * | 5/1945 | Wale . | |
| 2,915,894 | * | 12/1959 | Reichert . | |
| 3,311,996 | * | 4/1967 | Bergener . | |
| 3,706,170 | * | 12/1972 | Argraves et al. | 52/190 |
| 4,226,065 | * | 10/1980 | Jagemann | 52/189 |
| 4,597,236 | * | 7/1986 | Braxton | 52/564 |
| 5,014,475 | * | 5/1991 | Anderson, Jr. et al. | 52/19 |
| 5,409,325 | * | 4/1995 | Wu | 404/34 |
| 5,479,746 | * | 1/1996 | Mannonen | 52/182 |
| 6,176,049 | * | 1/2001 | Crant et al. | 52/188 |

* cited by examiner

*Primary Examiner*—Daniel P. Stodola
*Assistant Examiner*—Curtis Cohen
(74) *Attorney, Agent, or Firm*—Sokol Law Office

(57) ABSTRACT

The modular masonry step and deck assembly consists of a plurality of like-shaped risers and a plurality of like-shaped treads that enable the assembly to have a variety of shapes, sizes and heights to provide a custom fit to a variety of buildings, mobile homes or trailers. The risers are dry stacked in a multi-tier, multi-column, multi-row arrangement to form a base of the assembly. An inwardly expanding groove is formed in each corner of each riser. When aligned flush with adjacent risers and dry stacked one atop the other in a stacked bond arrangement, the groves form a continuous vertical channel. A semi-flexible locking key is formed inside the channel to secure the risers together, but accommodate movements caused by the freezing and thawing of the ground. Four differently shaped treads are used to form the walking surface of the step and deck assembly. Each tread shape is used to form a specific portion of the walking surface. A plurality of each like-shaped tread is used to form its specific portion of the walking surface to create a continuous lip around the perimeter of the steps and deck. Each of the four like-shaped treads has a specific design on its top surface to form an integral, continuous pattern on the steps and deck. The treads can be used to continue the design into a walkway.

16 Claims, 17 Drawing Sheets

MODULAR MASONRY STEP AND DECK ASSEMBLY

This application claims benefit of provisional application No. 60,083,671 filed Apr. 30, 1998.

TECHNICAL FIELD OF THE INVENTION

This invention relates to a modular masonry step and deck assembly for entering an elevated entrance to a building, the assembly including a plurality of dry stacked like-shaped risers and a plurality of like-shaped treads that can be assembled into a variety of shapes, sizes and heights to provide a custom fit for a variety of buildings, each tread having one of a few designs on its surface that combine to produce a continuous, integrated design.

BACKGROUND OF THE INVENTION

Foundations and entrances of buildings are typically elevated above ground level. Steps and a deck or stoop are provided to allow a person to walk or climb up to or near the level of the threshold of the door. Each step has a given rise and a given depth to allow the person to safely negotiate the step. A series of steps requires a certain amount of surface area in front of the door. The deck or stoop forms a platform with enough surface area for a person to safely open and enter or exit through the door. The size and shape of the available area for constructing the steps and deck varies due to obstructions, such as the building foundation, adjacent structures, driveways, walkways, trees, bushes and gardens. Other considerations, such as the locations of widows, mail boxes and sitting areas can also affect the location, size and shape of the step and deck construction.

A variety of approaches have been developed for constructing steps and decks leading into building. While some of these approaches provide flexible constructions that are easily adapted to the size and shape of a specific area, they lack durability and maintainability. Other approaches provide constructions that are durable and easy to maintain, but lack the flexibility to adapt to a variety of applications. These constructions can also be difficult to alter or remove. Providing a continuous, integrated design in the surface of conventional step and deck constructions creates further problems for conventional approaches.

Wooden step and deck assemblies are flexible and can be custom fit to the contours of a specific building, mobile home or trailer and its landscaping. A problem with wooden step and deck constructions is that they lack long term durability and require frequent upkeep due to the loosening of nails, screws, bolts or other fixtures, as well as the need for routine applications of weather inhibitors to slow down rotting caused by rain, wind, snow and ice. Additional types treatments are used to reduce the rate of deterioration of the wood resulting from the constant wear and tear of use, salt, gravel, dirt and even snow and ice removal. The smooth and frequently slippery surface of lacquered wood requires the use of anti-skid mats or strips to be applied to the walking surfaces. In addition, wooden step and deck constructions are typically anchored by several posts or supports embedded in the ground. These posts or supports can shift and heave over time, especially in regions subject to frequent freezing and thawing. Digging up and resetting these post or supports can be difficult and labor intensive, particularly in the cramped areas next to the building and its landscaping.

Precast concrete step and deck constructions are typically more durable and require less upkeep than wooden assemblies. However, the large slabs that form the steps and decks are heavy to lift and move, and difficult to align during installation. Motorized construction equipment or special tools are usually required. For cost reasons, manufacturers tend to massproduce a limited selection of precast step and deck slabs, each slab having a specific shape and size. The limited selection is frequently unable to conform to the size and shape of the area allocated for the step and deck construction. While custom precast concrete step and deck slabs are possible, the manufacturing and shipping costs result in significantly greater unit prices. Moving, removing, altering or adding to a large precast step or deck construction can also be labor intensive and expensive.

Poured concrete step and deck constructions conform to the specific building and landscape design. However, these constructions require the time and expense of building forms and the delivery or mixing of the concrete. Special layout, carpentry, and concrete finishing skills are also required. Poured concrete steps and decks are also prone to cracking due to the settling or freezing and thawing of the ground supporting the steps and deck. The removal or replacement of these larger poured concrete slabs can also be prohibitive. Again, large construction equipment can be required. As with precast constructions, removing, altering or adding to the precast construction can be labor intensive and expensive should the owner want to move, expand or add a handicap access ramp to the construction.

While dry stacked constructions have been developed to form retaining walls and building walls, the instability of a multi-column, multi-row, multi-tier dry stacked assembly has inhibited its adoption in step and deck constructions. Even a single column wall system will utilize a mechanism for securing the risers together. For example, many retaining wall systems utilize a projection extending from the lower surface of the block to grip the block beneath it. A variety of hardware fastening systems can also be used to secure the single column of blocks together. Retaining wall constructions typically stagger the blocks laterally from tier to tier to form a running bond construction that increases the strength of the wall. Each tier or course of blocks is also set back from its lower tier so that the wall leans into the hill it is retaining. While a staggered running block construction utilizing a set back is appropriate for a dry stacked retaining wall construction, such attributes render the blocks inappropriate for a step and deck assembly.

Some conventional warehouse wall constructions utilize a column of dry stacked blocks between poured concrete pillars. A fiberglass reinforced plastered sheet is placed on each side of the dry stacked blocks to keep them in place. The expense of forming poured concrete pillars and applying reinforced plaster sheets renders such a construction inappropriate for a step and deck assembly. Pouring concrete down the hollowed out cores of the dry stacked blocks to hold them in place is also known. However, such constructions include the expense of a significant amount of concrete, as well as the mess of mixing and filling the cores of the stacked blocks. Such constructions are also difficult to remove or alter.

Incorporating a continuous, integrated pattern into the walking surface of a masonry step and deck construction further complicates its design. While a precast step and deck slab construction can incorporate a pattern on its surface, these patterns make it even more difficult to integrate two separate slabs. Poured concrete constructions require a skilled mason to form the design into the concrete while it is setting, which further adds to the cost and inconvenience of such constructions. Extending the continuous pattern into the walkway leading to the steps and deck creates further problems. Precast concrete steps and decks are not sized or shaped to create walkways. Poured concrete walkways with hand formed designs add to an already expensive construction technique.

The present invention is intended to solve these and other problems.

BRIEF DESCRIPTION OF THE INVENTION

The present invention relates to a modular masonry step and deck assembly consisting of a plurality of like-shaped risers and a plurality of like-shaped treads that enable the assembly to have a variety of shapes, sizes and heights to provide a custom fit to a variety of buildings, mobile homes or trailers. The risers are dry stacked in a multi-tier, multi-column, multi-row arrangement to form a base of the assembly. An inwardly expanding groove is formed in each corner of each riser. When aligned flush with adjacent risers and dry stacked one atop the other in a stacked bond arrangement, the groves form a continuous vertical channel. A semi-flexible locking key is formed inside the channel to secure the risers together, but accommodate movements caused by the freezing and thawing of the ground. Four differently shaped treads are used to form the walking surface of the step and deck assembly. Each tread shape is used to form a specific portion of the walking surface. A plurality of each like-shaped tread is used to form its specific portion of the walking surface to create a continuous lip around the perimeter of the steps and deck. Each of the four like-shaped treads has a specific design on its top surface to form an integral, continuous pattern on the steps and deck. The treads can be used to continue the design into a walkway.

One advantage of the present masonry step and deck assembly is that the modular structure of its components provides the flexibility to produce a customized fit to accommodate the size and shape of the available area for various buildings. The number of tiers, rows and columns of risers forming the base of the assembly can be varied to accommodate the height of the door, the shape of the building foundation, adjacent structures, driveways, walkways, and landscaping, such as trees, bushes and gardens. The step and deck assembly can also be constructed to accommodate the locations of widows, mailboxes and sitting areas. The modular construction also allows the components to be sized so that a homeowner can lift and align them by themselves without the aid of motorized equipment or special tools.

A further advantage of the present masonry step and deck assembly is that the semi-flexible locking keys permit a degree of movement between adjacent risers. This gives the unitary base the ability to absorb movements in the ground caused by freezing and thawing. No mortar is needed which would inhibit the flexibility of the base and crack over time. Instead, the semi-flexible keys continue to hold the risers together to form the unitary base even when the risers are moved out of direct flush contact with their adjacent risers. The flexible keys also allow the risers to move back into direct flush contact when the ground settles back to its unfrozen condition. Instead of using embedded posts, the entire unitary base can be said to float on the ground.

Another advantage to the present masonry step and deck assembly is its durability and relatively maintenance free upkeep. The masonry treads are capable of handling heavy traffic for over relatively long periods of time without showing signs of war and tear, even when subjected to salt, gravel, dirt, and snow and ice removal. No nails, screws or bolts need to be tightened. Weather inhibitors and other protective coatings are not necessary to prevent or reduce the rate of deterioration of the masonry components.

A still further advantage of the present masonry step and deck assembly is that it enables a home owner to easily customize the step and deck assembly to fit their specific home, identify and procure the necessary components, and install the assembly. No, special layout, carpentry, and concrete finishing skills are also required. No forms need to be built, and no concrete needs to be delivered or mixed. The unitary base is constructed entirely of whole risers. No splitting of risers is required as in a staggered running bond arrangement.

A still further advantage to the present masonry step and deck assembly is that its modular design is readily disassembled for moving to a new location or discarded. The assembly can also be altered or additional sections can be added to enlarge the step and deck assembly. Moving and modifying the assembly can be done by an individual homeowner without the need of motorized equipment or special tools. The assembly can be easily removed from a tight area without disturbing the surrounding. Once installed the design can be readily altered or expanded as desired, such as to add a handicap access ramp.

A still further advantage to the present masonry step and deck assembly is the limited number of differently shaped components that are required to complete any size, shape or height. Only a single riser and four treads are required to construct a wide variety of step and deck designs. This limited number of components provides significant economies in the manufacturing, distribution, retail sales, construction, and repair or redesign of the assembly. During manufacture, there are fewer forms to design, maintain and store. Fewer manufacturing set ups and down times are required to produce a complete assembly. Fewer risers and treads need to be maintained in inventory and tracked during shipping. These savings are again realized at the retail level, where space is limited and expensive. The limited number of components also assists the home owner in designing, hauling and constructing a deck and step assembly for their home.

A still further advantage of the present masonry step and deck assembly is that the treads form a continuous lip around the steps and deck. The lip increases the depth dimension of each step, without requiring an increase in the depth dimension of the risers. The narrower the risers, the more possibilities there are to vary the overall depth of the unitary base. This improves the overall flexibility of the step and deck assembly and the ability to achieve a custom fit for a particular home or building.

A still further advantage to the present masonry step and deck assembly is that the treads provide grooves near the outer edges of each step. These grooves provide traction for a person walking up or down the steps.

A still further advantage to the present masonry step and deck assembly is that it incorporates a continuous, integrated pattern on the walking surface of a step and deck assembly. Each of the four differently shaped treads has a different pattern of grooves formed into its upper surface. The grove pattern is dependent on the specific portion of the walking surface in which it is placed, and the intended overall design of the step and deck assembly. By placing each tread in its specific portion of the assembly, the design of each tread will be integrated with the design of the treads placed in adjacent portions of the assembly. The treads can also be used to form a walkway. Accordingly, the continuous, integrated pattern can be extended from the surfaces of the steps and deck to include the walkway as well.

Other aspects and advantages of the invention will become apparent upon making reference to the specification, claims and drawings.

DESCRIPTION OF THE PREFERRED EMBODIMENTS

While this invention is susceptible of embodiment in many different forms, the drawings show and the specification describes in detail a preferred embodiment of the invention. It should be understood that the drawings and specification are to be considered an exemplification of the principles of the invention. They are not intended to limit the broad aspects of the invention to the embodiment illustrated.

Figure 1:
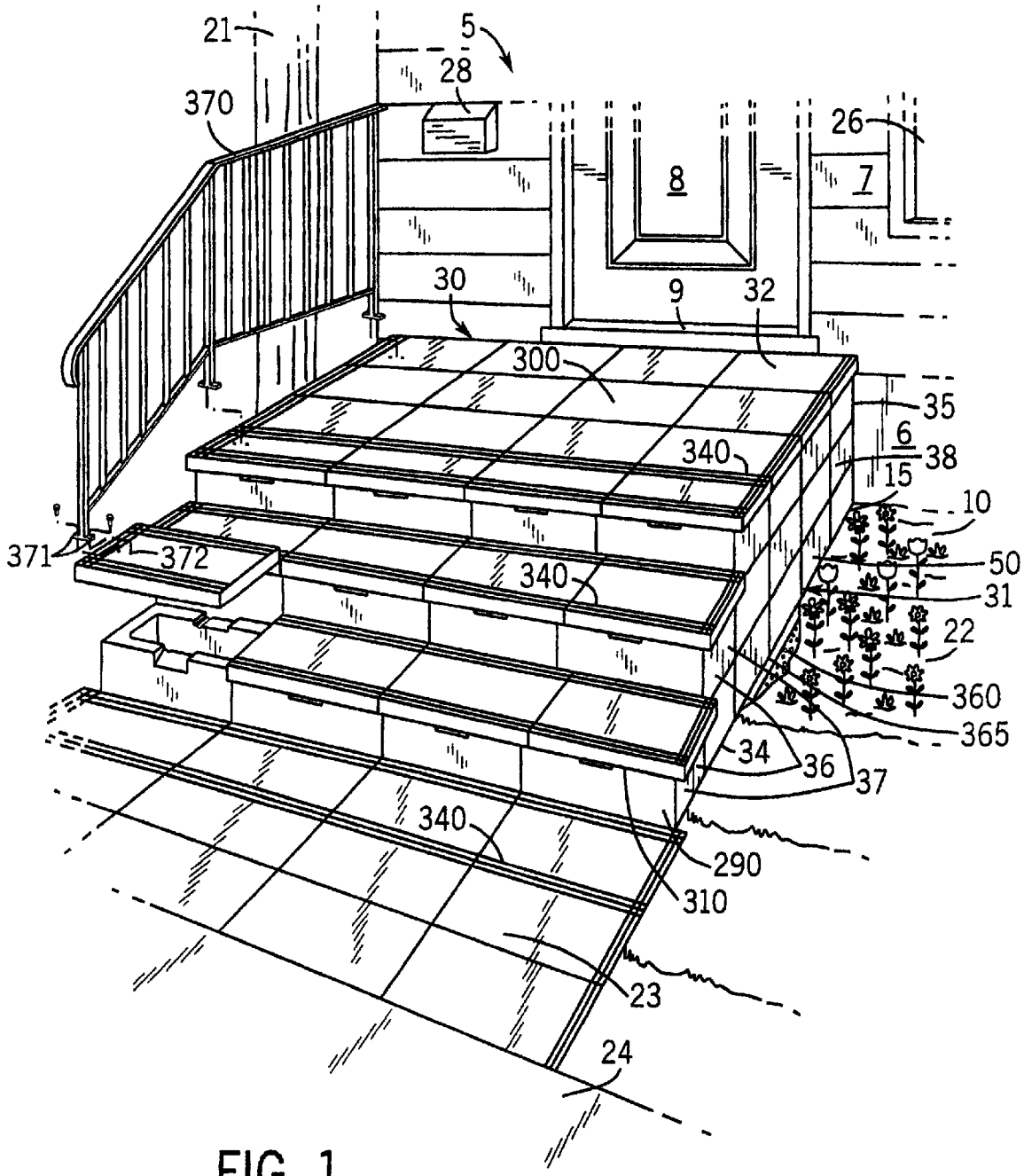
FIG. 1 is a perspective view of the modular masonry step and deck assembly having three tiers, four rows and six columns to provide a custom fit for a specific house, and with its continuous design extending across the walking surface of the assembly and down a walkway.

FIG. 1 shows a house 5 with a concrete foundation 6, walls 7 and a door or entrance 8. The door 8 has a threshold 9 elevated a specific height above the level of the ground 10 in an area 15 in front of the door. Several obstructions are located around the door 8. These obstructions include a tree 21 located to the left of the door 8, a garden 22 located to the right, a walkway 23 leading to a driveway 24 in front of the house, and the foundation 6 located directly beneath the door8. The house 5 also includes structural features such as a window 26 located to the right of the door 8 and a mailbox 28 located to the left. These obstructions and features define the usable area 15 for constructing a step and deck constructions, such as the modular step and deck assembly identified as reference number 30. While the building is shown to be a house setting on a foundation, it should be understood that the building could also be a mobile home or a portable trailer such as the type found on a construction site.

The modular masonry step and deck assembly 30 includes a unitary base 31 and a walking surface 32. The assembly 30 has a lower surface 34 that rests on the ground 10, and a rear surface 35 that abuts a planar surface of the foundation 6 below the door 8. The assembly 30 has a step portion 36 that includes a plurality of steps 37 located in front of the door 8, and a deck portion 38 located proximal the door. Although the step portion 36 is shown in front of the door 8 with the deck portion 38 in between, it should be understood that the assembly could be constructed with the step portion located to the right or left of the door.

Figure 2:
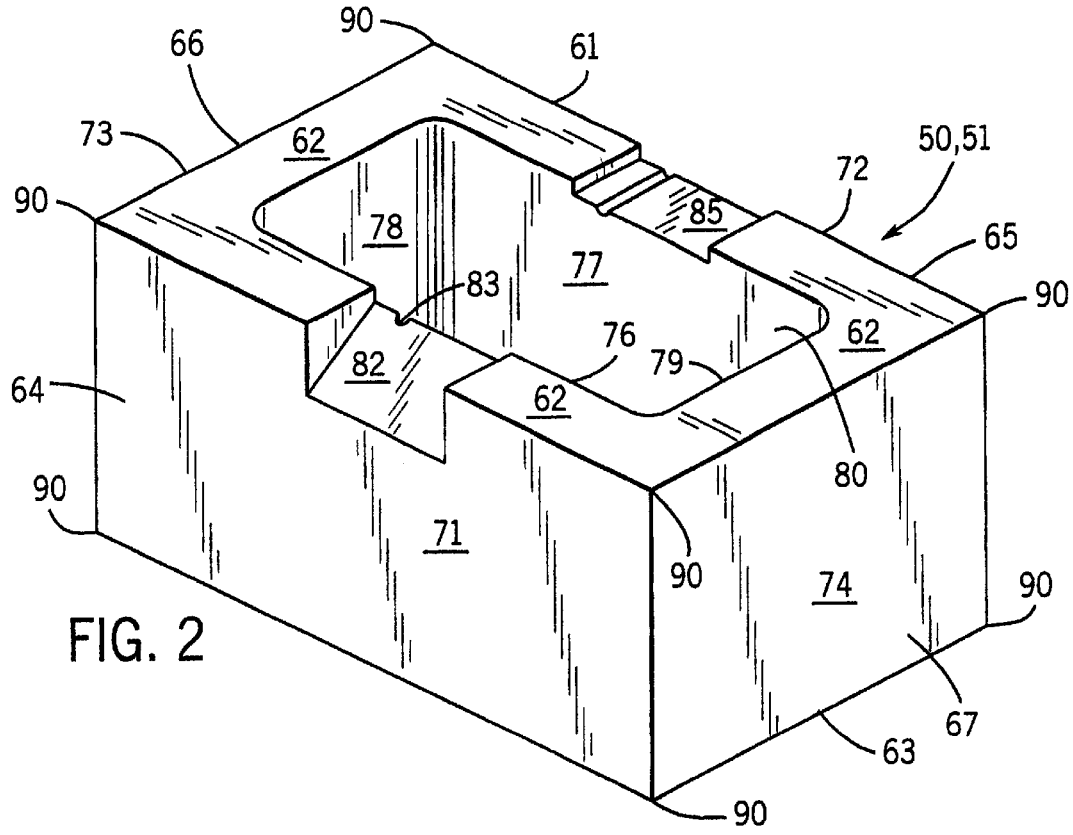
FIG. 2 is a perspective view of a first embodiment of a riser with a light slot formed in one longitudinal wall and a wiring notch in the opposite longitudinal wall.
Figure 3:
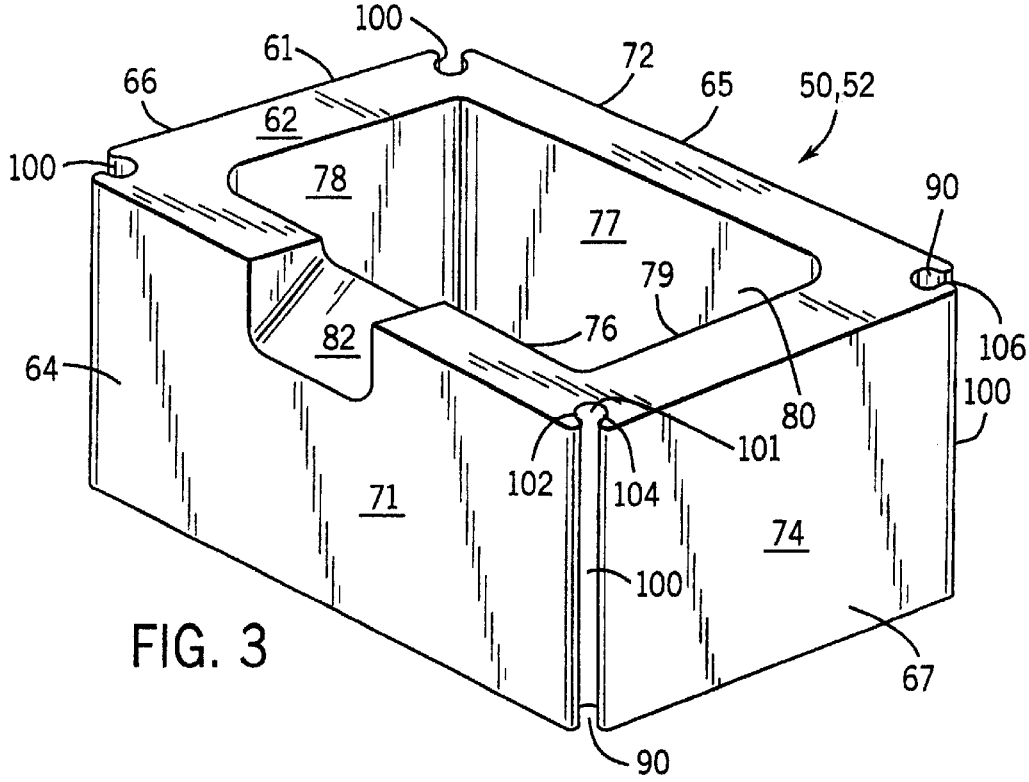
FIGS. 3A–E are perspective, front plan, side plan, rear plan and top views of a second embodiment of the riser with a light slot formed in one longitudinal wall and a vertical groove with an inwardly expanding cross-sectional area formed in each vertical corner.
Figure 3A:
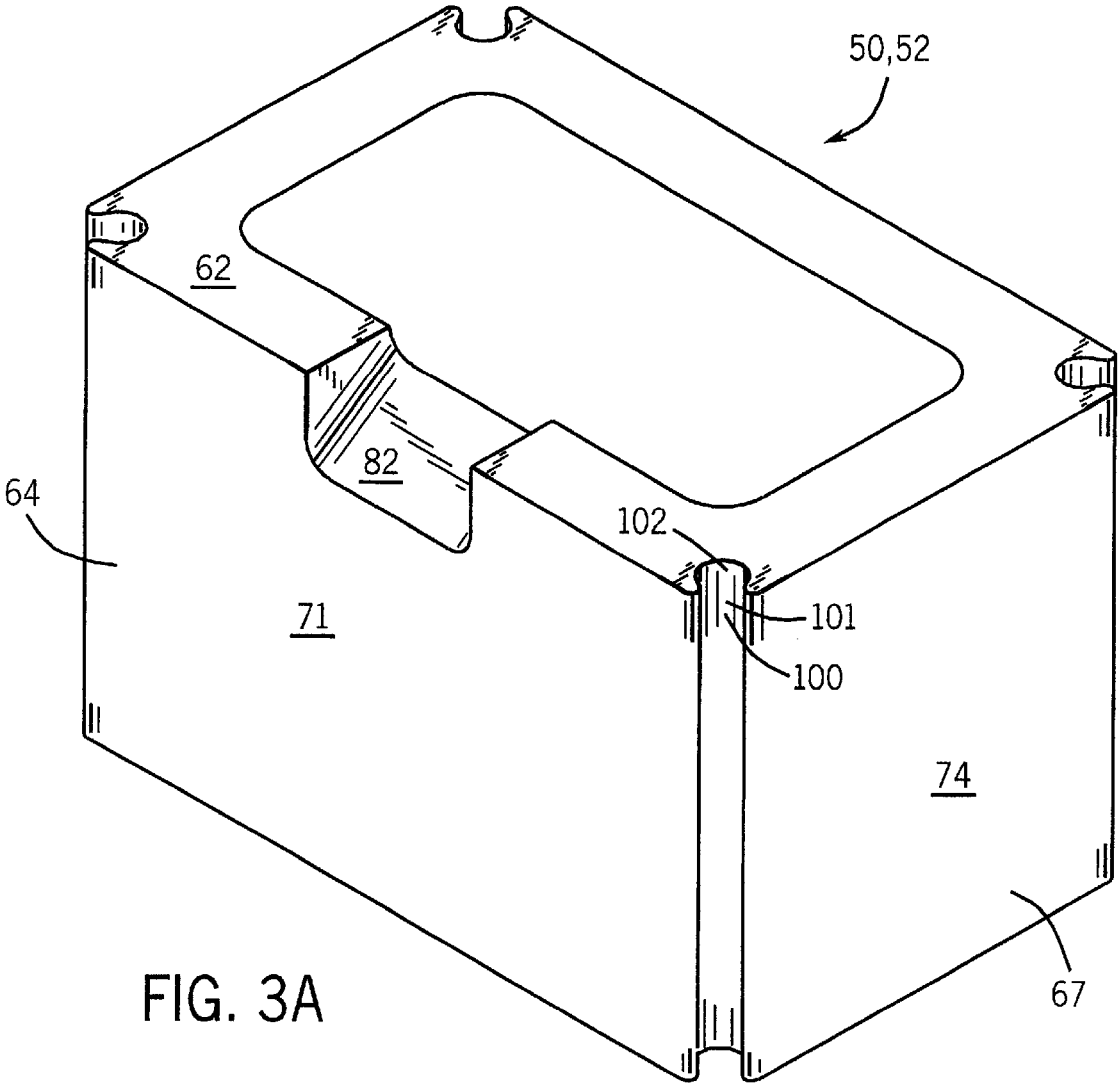
Figure 3B:
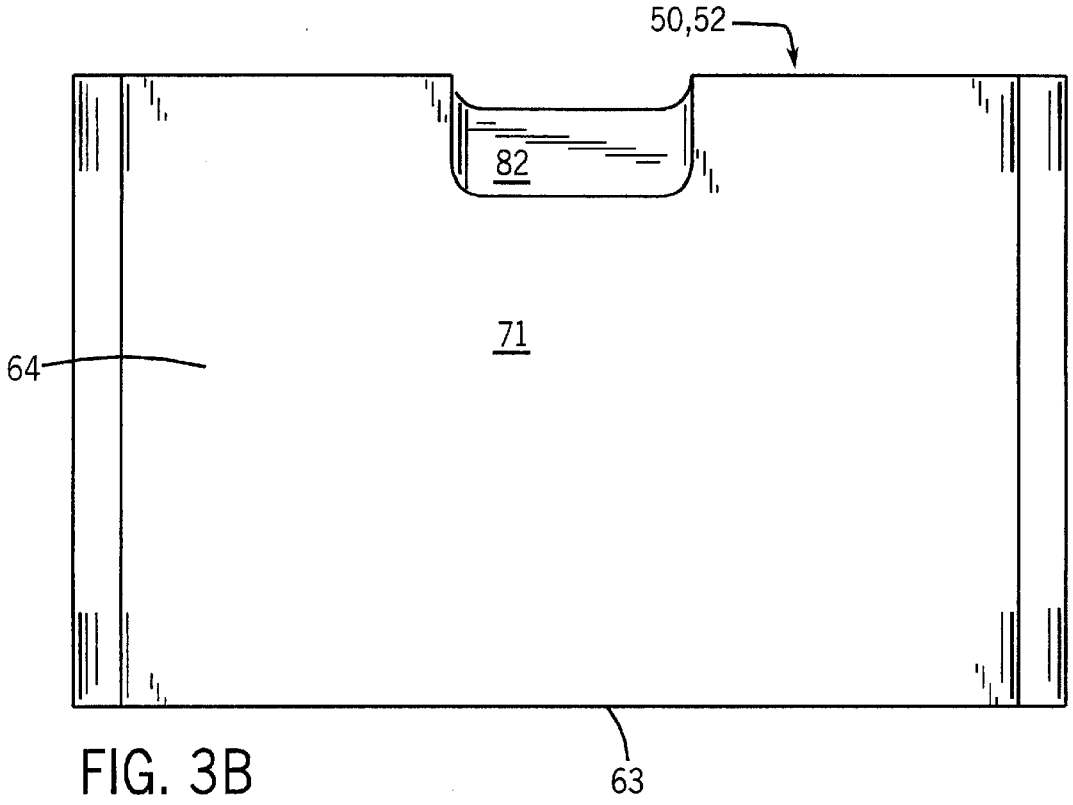
Figure 3C:
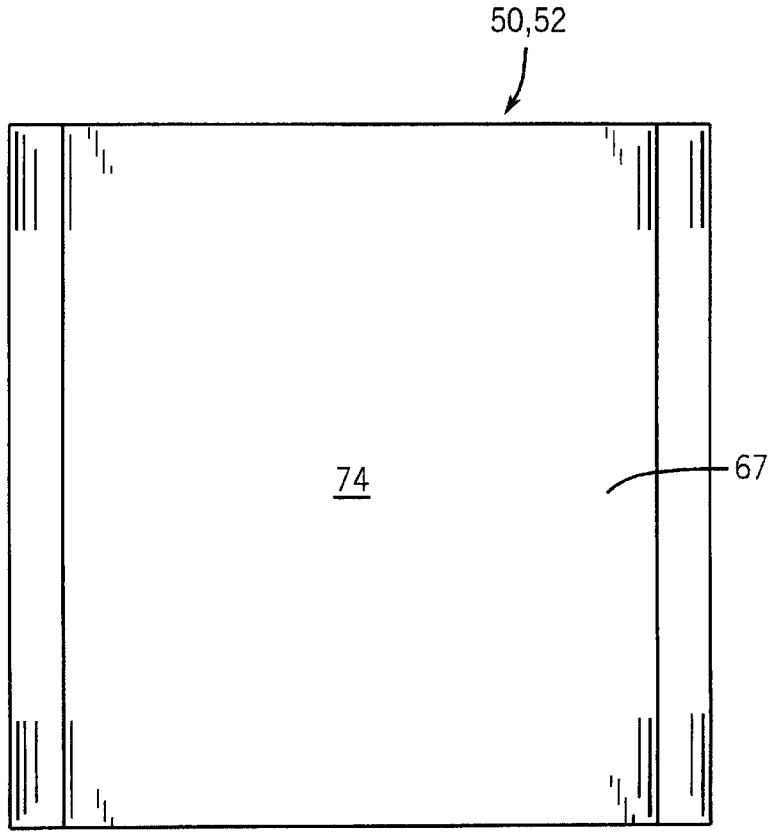
Figure 3D:
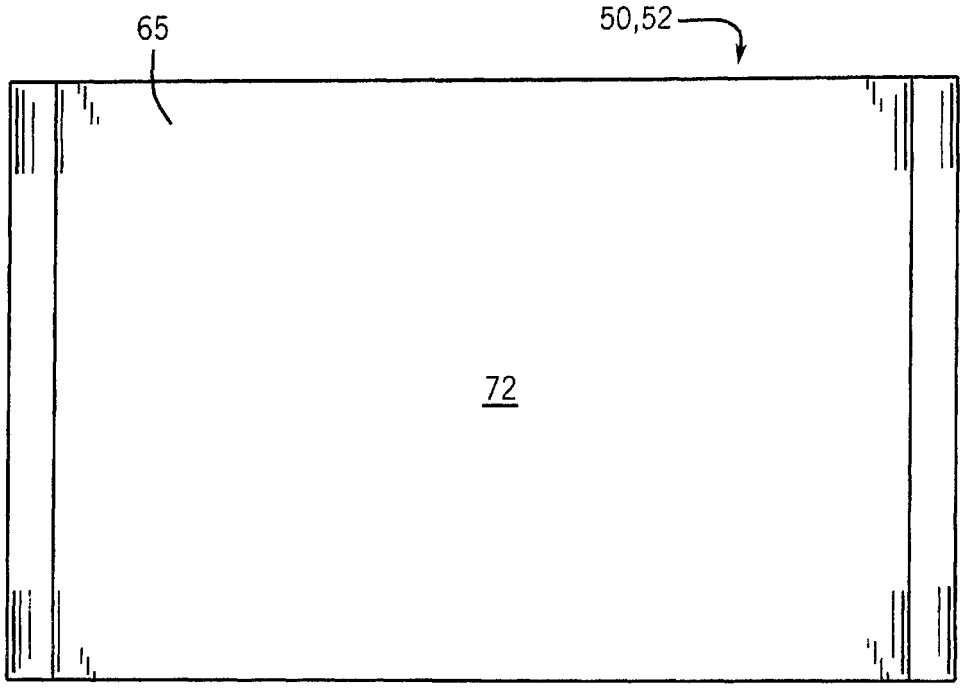
Figure 3E:
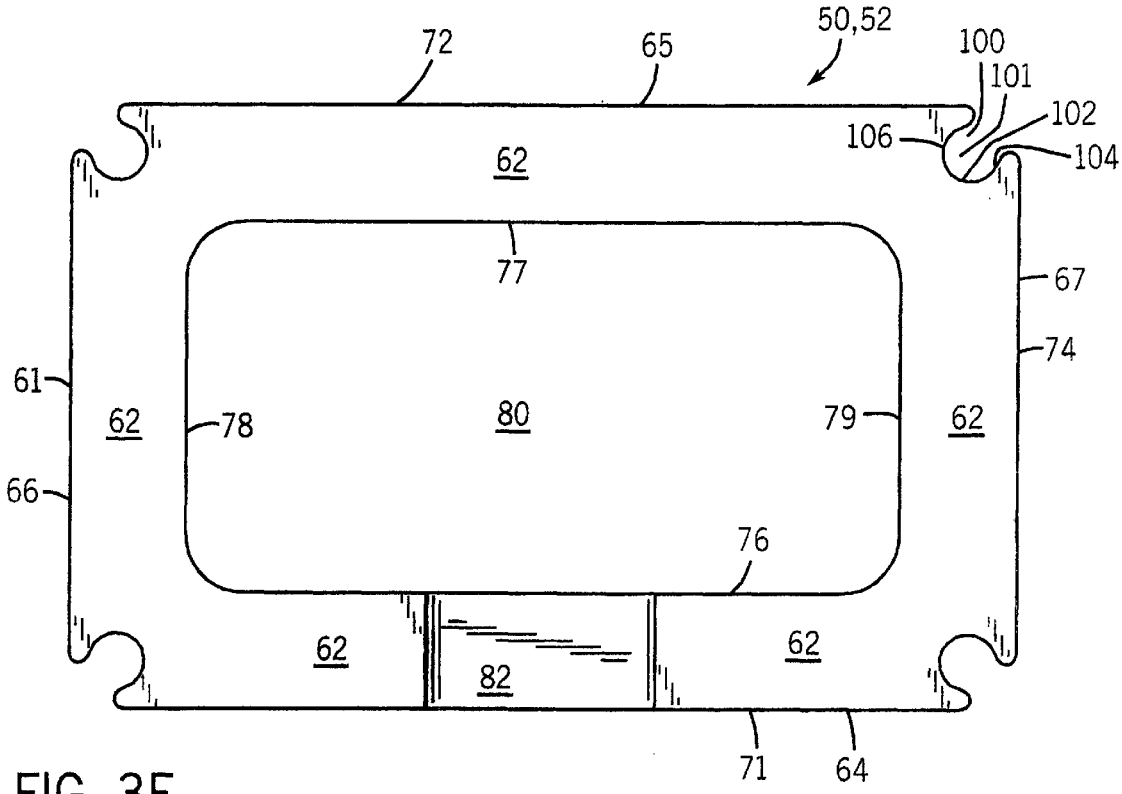
Figure 6:
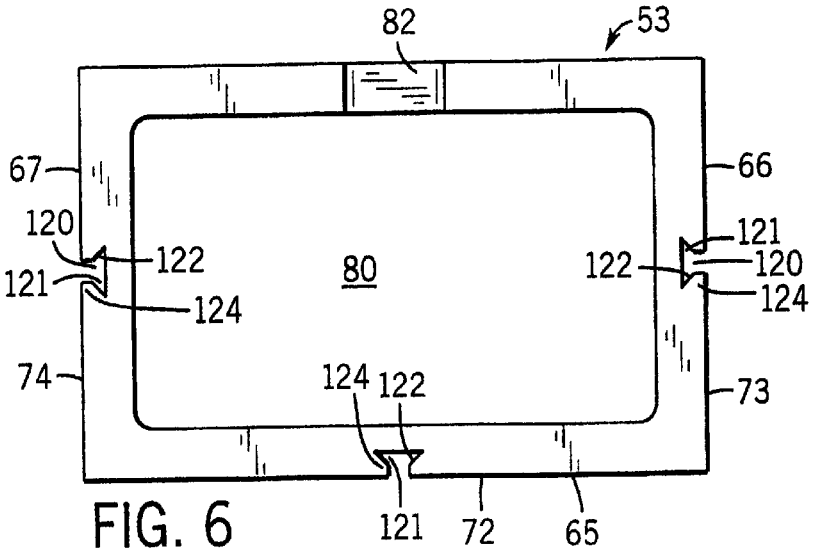
FIG. 6 is a top view showing a third embodiment of the riser with a light slot formed in one longitudinal wall and a groove having an inwardly expanding cross-sectional area formed at the central point of the other three walls.

The unitary base 31 is formed by a plurality of like-shaped risers 50. The risers 50 are formed of a high strength cementitious material, such as concrete formulated to ASTM specification C-936. Concrete of such specification is designed for use as interlocking paving blocks and has a strength of 8,000 psi. The risers 50 can take several different forms as shown in FIGS. 2, 3 and 6. Each embodiment 51, 52 or 53 of the riser 50 includes a main body 61 having a planar top surface 62 that is parallel to its planar bottom surface 63. The risers 51–53 also includes four side walls 64–67, which for the purpose of clarity may be referred to as the front wall 64, rear wall 65 and opposed side walls 66 and 67. The front and rear or longitudinal walls 64 and 65 are longer than the side or transverse walls 66 and 67 to give the riser its rectangular shape.

Each side wall 64–67 of the riser 50 has a planar outside surface 71–74. Each outside surface 71–74 intersects its adjacent outside surfaces and the top and bottom surfaces 62 and 63 at a right angle. The outside surfaces 71 and 72 of front and rear walls 64 and 65 are parallel, as are the outside surfaces 73 and 74 of side walls 66 and 67. These parallel surfaces 62–67 give the rectangular riser 50 a uniform height dimension of about 8 inches from top to bottom 62 and 63, a uniform width dimension of about 15 and ⅝ inches from side to side 66 and 67, and a uniform depth dimensions of about 9 and ⅝ inches from front to rear 64 and 65. The outside surfaces 71–74 of the risers have a decorative pattern (not shown) consisting of many closely spaced vertical corrugated ridges. The side walls 64–67 have inside surfaces 76–79 that define a hollow inner core 80 that passes completely through the riser 50.

As shown in FIG. 2, the first embodiment 51 of riser 50 includes a first slot 82 for holding a light fixture (not shown). The slot 82 is formed into the top surface 62 of the riser 51 at the center of the front wall 64. The slot 82 has a sloped lower surface that produces a larger recess in the outer surface 71 and a smaller recess in the inside surface 76. A notch 83 is formed in the inside recess to accommodate a wire (not shown) of the light fixture. A second slot 85 is located in the top surface 62 toward the center of the rear wall 65. A notch is formed in the lower surface of the slot 85 for routing the electrical wire to the light fixture. Adjacent outside surfaces 71–74 meet to form the vertical corners 90 of the riser 51.

Figure 5:
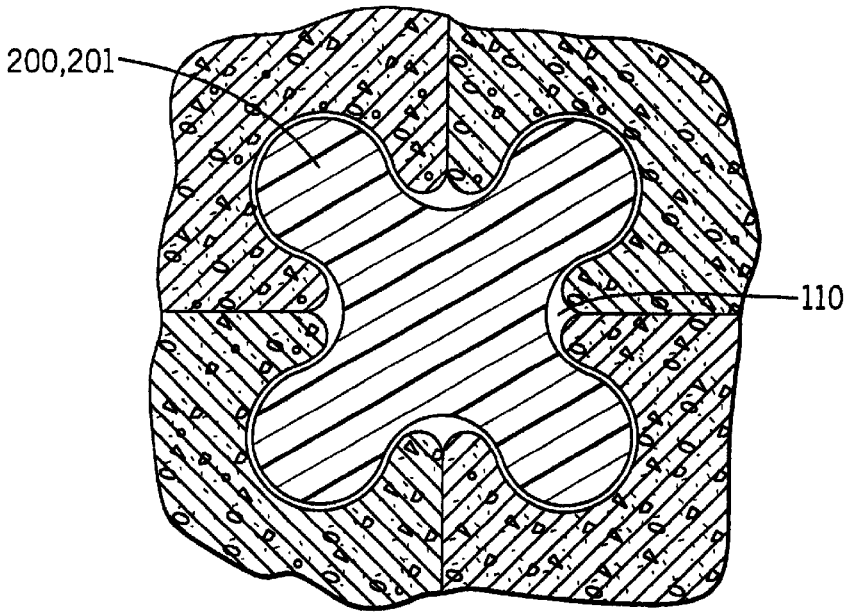
FIG. 5 is a top view of a clover-shaped locking key inserted into a channel formed by four flushly aligned risers with their side wall surfaces in direct contact.

The second embodiment 52 of the riser 50 is shown in FIGS. 3A–E. Riser 52 includes the slot 82 for the light fixture, but omits slot 85. The electrical wires can be routed down through the inner core 80 of the riser and underground. Vertical grooves 100 are formed into the corners 90 of the riser 52. Each groove 100 has an inwardly expanding cross-sectional shape 101 formed by an arcuate shaped wall 102 having a narrow neck 104 near the surfaces 71–74 of the riser 52 and a wider circular inner portion 106 formed in the walls 64–67. Each groove 100 maintains this uniform cross-sectional shape 101 as it spans from the top 62 to the bottom 63 surface of the riser 52. When four risers 52 are aligned in a side-by-side arrangement with their outside surfaces 71–74 aligned flush and in direct contact as in FIG. 5, the corner grooves 100 of the risers combine to form a single channel 110 with a cloverleaf-shaped cross-sectional area, each leaf being formed by one groove of each riser.

Figure 8:
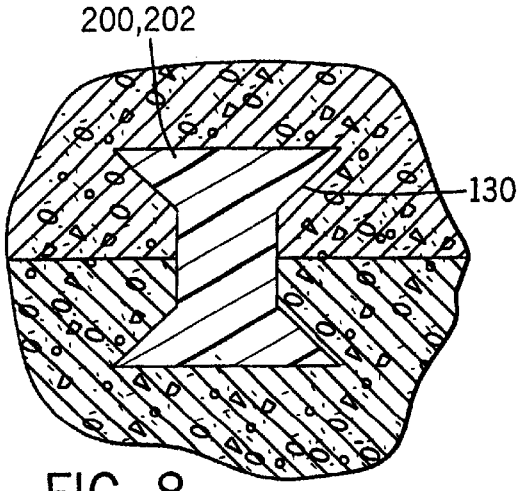
FIG. 8 is a top view of an hourglass-shaped locking key inserted into a channel formed by two flushly aligned risers with their side wall surfaces in direct contact.

The third embodiment 53 of the riser 50 is shown in FIG. 6. Riser 53 also includes the slot 82 for the light fixture, but omits slot 85. Vertical grooves 120 are formed along the center points of both rear wall 65 and side walls 66 and 67. Each groove 120 has an inwardly expanding cross-sectional shape 121 formed by angled walls 122 that come together near the surfaces 72–74 of the riser 53 to form a narrow neck 124, and a widening trapezoidal shaped inner portion formed in the walls 65–67. Each groove 120 maintains this uniform cross-sectional shape 121 as it spans from the top 62 to the bottom 63 surface of the riser 53. When two risers 53 are aligned in a side-by-side arrangement with their outside surfaces 71–74 aligned flush and in direct contact as in FIG. 8, the grooves 120 combine to form a single channel 130 with an hourglass-like cross-sectional shape, each half of the hourglass being formed by one groove 120 of each riser.

The risers 50 are dry stacked to form several tiers 150. The tiers 150 include a ground tier 152 and several stacked tiers 154, including an upper tier 156. Each tier 150 is arranged into multiple rows 160 and multiple columns 162 of risers 50. Each tier has the same number of rows 160, but the ground tier 152 has the largest number of columns 162. Each stacked tier 154 is placed atop an immediately lower tier 164. Each tier 150 has a pair of opposed end rows 165 and 166 and a front column 168. Each stacked tier 154 has one fewer columns 162 than its immediately lower tier 164. The stacked tier 154 is staggered from the front column 168 of its immediately lower tier 164.

Each of the front columns 168 has two opposed corner risers 170, and a remaining front portion 172 that includes two more risers. The end rows 165 and 166 of the upper tier 156 includes a corner riser 170. The end rows also include a remaining side portion 174 that includes three more risers. The upper tier also has an interior portion 176 of risers 50. The rear surface 35 of the assembly 30 is formed by the tiers 150. This rear surface 35 forms a common planar surface 178 adapted for alignment with the foundation 6 of the building 5.

The risers 50 forming the unitary base 31 are dry stacked in a stacked-bond arrangement, each stacked riser 50 setting directly atop another. The side wall surfaces 71–74 of each stacked riser 50 is in coplanar alignment with the side wall surfaces 71–74 of the riser on which it is stacked. Adjacent risers 50 in the same tier 150 are aligned in a side-by-side arrangement with their outside surfaces 71–74 in aligned flushly and in direct contact as in FIG. 5. The corner grooves 100 of the risers 150 combine to form the cloverleaf-shaped channel 110. Because of the stacked-bond arrangement of the risers 50, each channel 110 formed by four adjacent risers of a given tier 150 is aligned with the channel 110 formed by the four adjacent risers upon which they are stacked. Accordingly, the channels 110 of each tier 150 combine in a linear manner to form a continuous channel 130.

Figure 4:
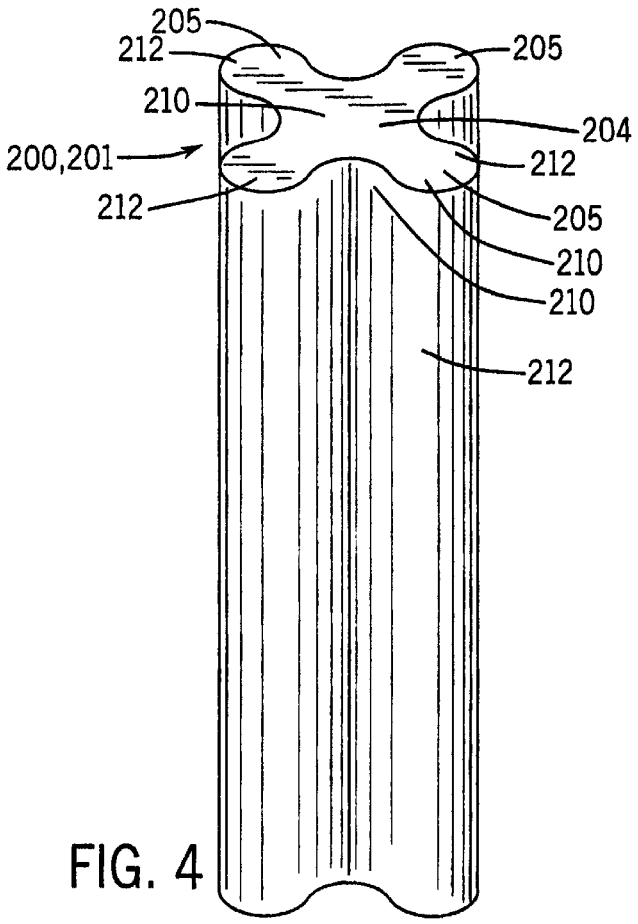
FIG. 4 is a perspective view of a semi-flexible, locking key having a crossectional area with a clover-like shape.
Figure 7:
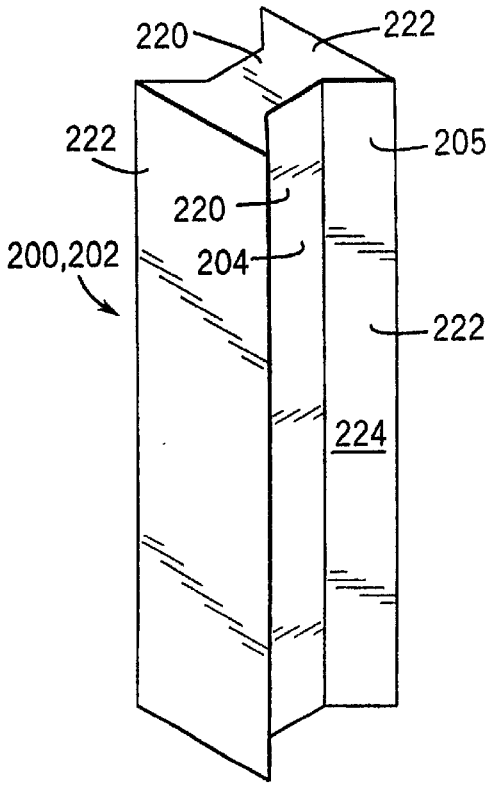
FIG. 7 is a perspective view of a semi-flexible, locking key having a crossectional area with an hourglass-like shape.

A plurality of elongated locking keys 201 or 202 of the type shown in FIGS. 4 and 7 are used to secure the tiers 150, rows 160 and columns 162 of risers 50 together to form the unitary base 31. These locking keys 200 are made of a semi-flexible material. While generally maintaining its shape to secure the risers 50 in place, the semi-flexible keys 200 will bend and stretch to a limited degree. The limited amount of bending and stretching allows the risers 50 forming the unitary base 31 to move slightly with respect to each other.

A clover-shaped locking key 201 is used with risers 52 having a vertical groove 100 in the corners of the side walls 64–67 as shown in FIG. 4. An hourglass-shaped key 202 is used with risers 52 having a vertical groove 100 in the center of the side walls 64–67 as shown in FIG. 7. Both keys have a narrow central body portion 204 and an outwardly expanding wider portion or finger 205. The clover-shaped key 201 has four fingers or lobs 205. Each finger 205 has a narrow neck portion 210 and a wider outer circular portion 212. Each finger or lob 205 is shaped to snugly fit into one of the vertical groove 100 of riser 52. The hourglass-shaped key 202 has a narrow middle portion 220 formed by two parallel walls. Two expanding trapezoidal extensions 222 extend from opposite ends of the middle portion 220. Each extension 222 has a pair of angled walls 224 that diverge away from the narrow middle portions 220. extensions 222 extend from opposite ends of the middle portion 220. Each extension 222 has a pair of angled walls 224 that diverge away from the narrow middle portions 220.

Figure 14:
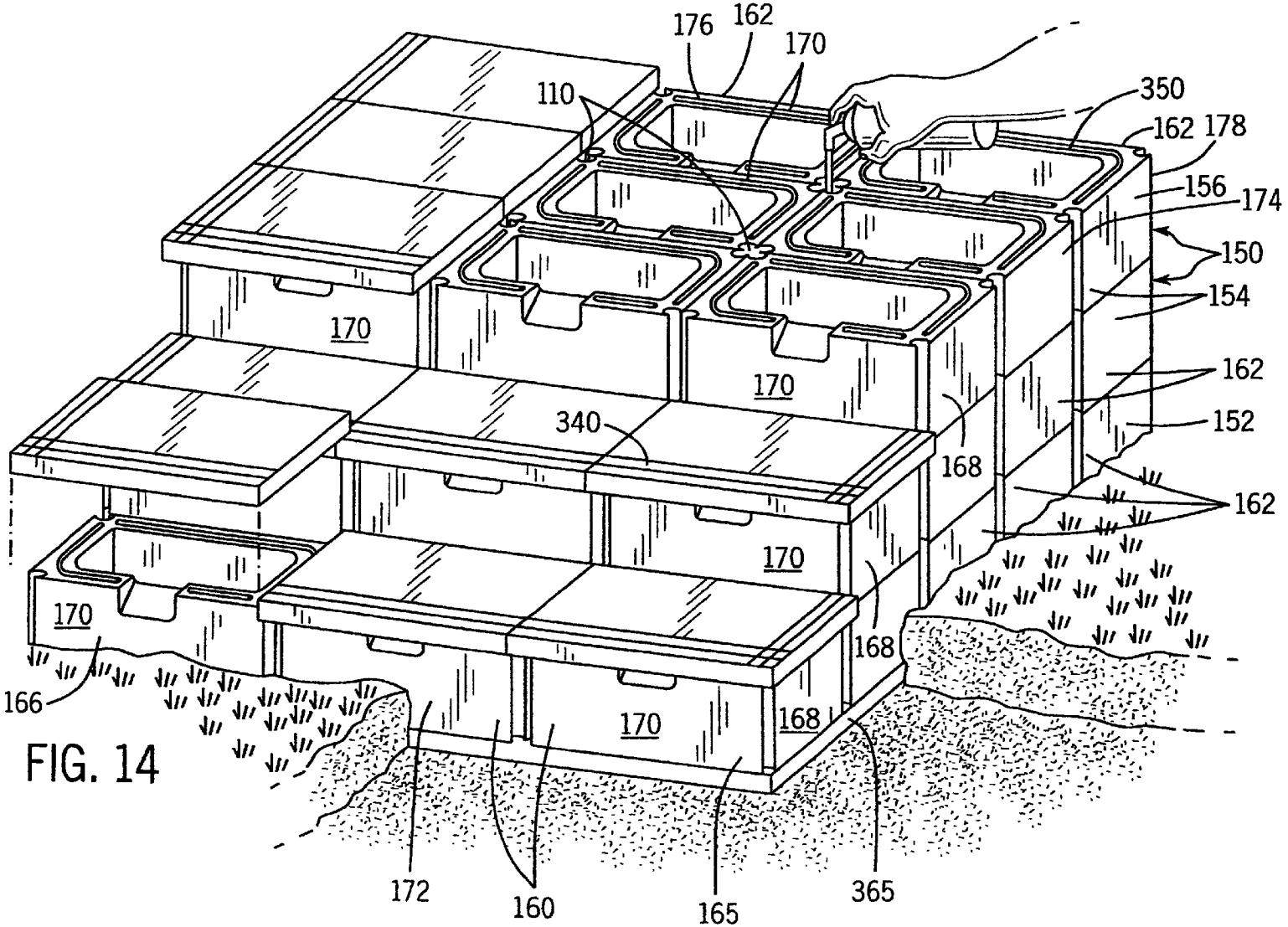
FIG. 14 is a perspective view of a partially assembled step and deck assembly showing the placement of the risers and treads and the injection of a foam spray to form one of the semi-flexible locking keys.

One locking key 201 or 202 is inserted into each continuous channel 130. Each elongated locking key 200 extends from the bottom surface 63 of the risers 50 forming the ground tier 152, to the top surface 62 of the risers forming the upper tier 156. The locking key 200 may also be formed directly in the continuous channels 130 by injecting a foam spray into the continuous channels. When sprayed from a can as shown in FIG. 14, the foam expands to fill the cavity formed by the continuous channel 130. The foam spray is believed to be made of a polyurethane intermediate which is made up of polymeric diisocyanate polyols and a hydrocarbon gas mixture.

As shown in FIGS. 9–12, a plurality of like-shaped corner treads 250, like-shaped front treads, 260, like-shaped side treads 270 and like-shaped inner treads 280 are place on the risers 50 to form the walking surface 32. These treads are made of the same masonry material as the risers 50. Each tread 250, 260, 270 and 280 has substantially planar top 251, 261, 271 and 281 and bottom 252, 262, 272 and 282 surfaces, and front 253, 263, 273 and 283, rear 254, 264, 274 and 284, and opposed side 255, 265, 275 and 285 wall surfaces. Each tread has a uniform height dimension from top 251, 261, 271 and 281to bottom 252, 262, 272 and 282. Each of these wall surface is substantially at a right angle to its adjacent wall surfaces.

As best seen in FIG. 14, each corner tread 250 is placed on the upper surface 62 of one corner risers 170. Each corner tread 250 has uniform width and depth dimensions that is about one inch greater than the respective width and depth dimensions of the like-shaped risers 50. Two adjacent side wall surfaces of each corner tread 250 are coplanar with two of the side wall surfaces 71–74 of the riser 50 on which it is placed. Each front tread 260 has a uniform width dimension that is equal to the width dimension of the risers 50 and a uniform depth dimension that is equal to said depth dimension of the corner treads 250. Each of the side treads 270 has a uniform width dimension that is equal to the width dimension of the corner treads 250 and a depth dimension that is equal to the depth dimension of the risers 50. Each of the front and side treads 260 and 270 has three side wall surfaces that are coplanar to the side wall surfaces of the riser 50 on which they are placed. Each inner tread 280 has uniform width and depth dimensions that are equal to the respective width and depth dimensions of the risers 50. Each of the side wall surfaces 283, 284 and 285 of the inner tread 280 are coplanar with the side wall surfaces 71–74 of the riser 50 on which they are placed.

The corner treads 250 and front treads 260 combine to form a plurality of steps 290 on the front columns 168 of each tier 150. One corner tread 250 is placed on each of corner risers 170. One front tread 260 is placed on each of risers 50 in the remaining front portion 172 of the front column 168. The side treads 270 and inner treads 280 combine to form a deck 300. One side tread 270 is placed on each of the risers forming the remaining side portions 174 of the upper tier 156. One of the inner treads 280 is placed on each of the risers 50 forming the interior portion 176 of said upper tier 156. The non-coplanar side wall surfaces of the corner 250 and front 260 treads extend outward from their respective risers 50, and combine to form a continuous lip 310 of about one inch around each of step 290. The corner 250, front 260 and side 270 treads form the continuous lip 310 around the step and deck of the upper tier 156.

Figure 9A:
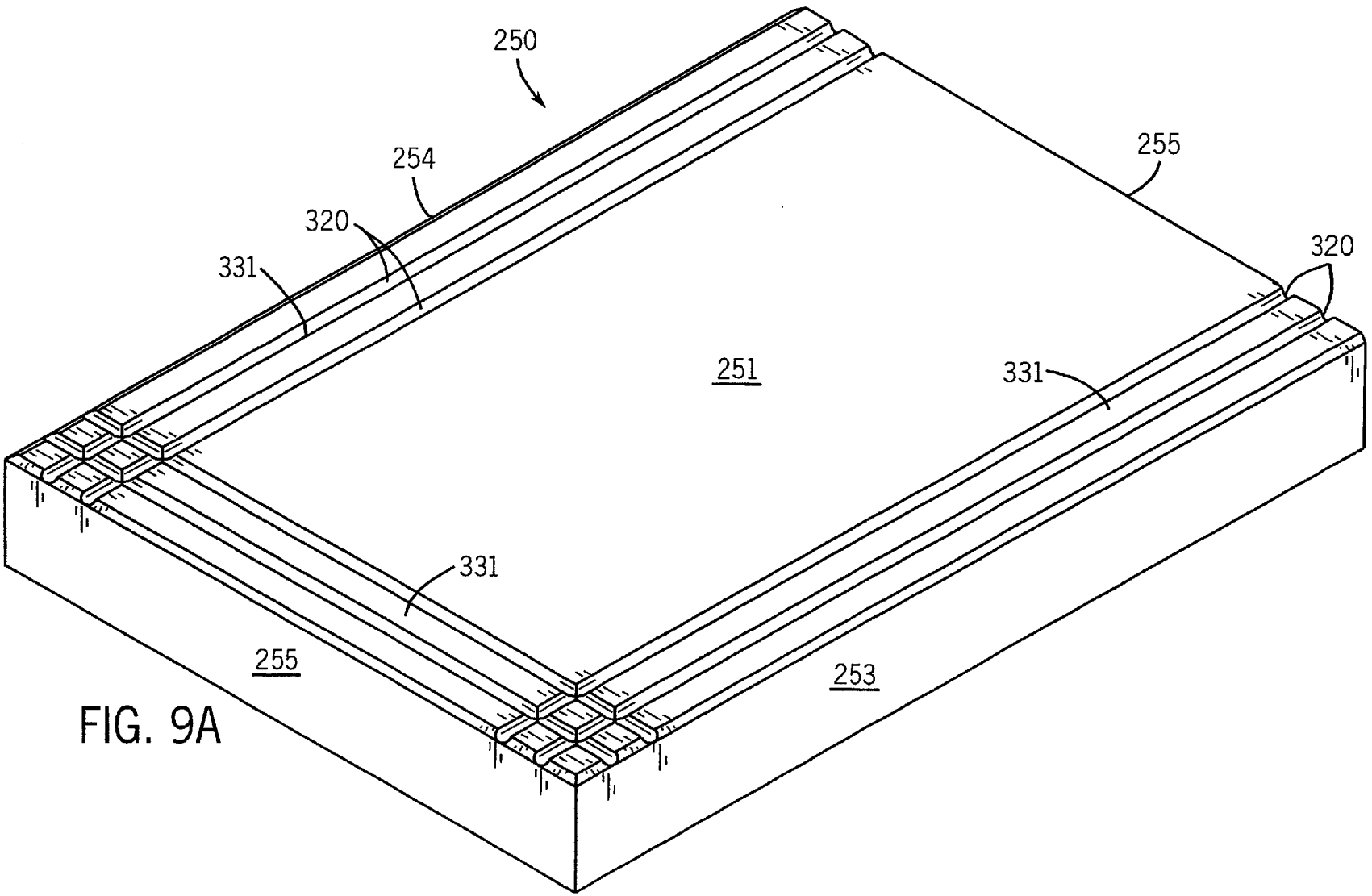
FIGS. 9A–D are perspective, front plan, side plan and top views respecively of a corner tread having a pair of parallel grooves formed into its upper surface along three of its edges.
Figure 9B:
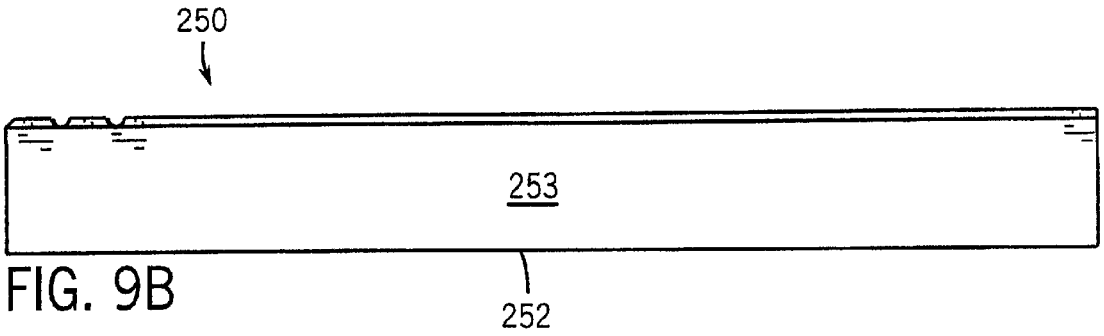
Figure 9C:
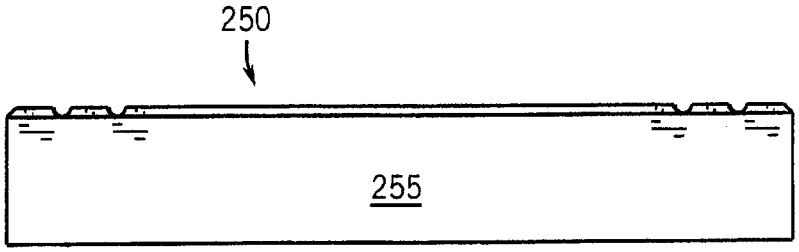
Figure 9D:
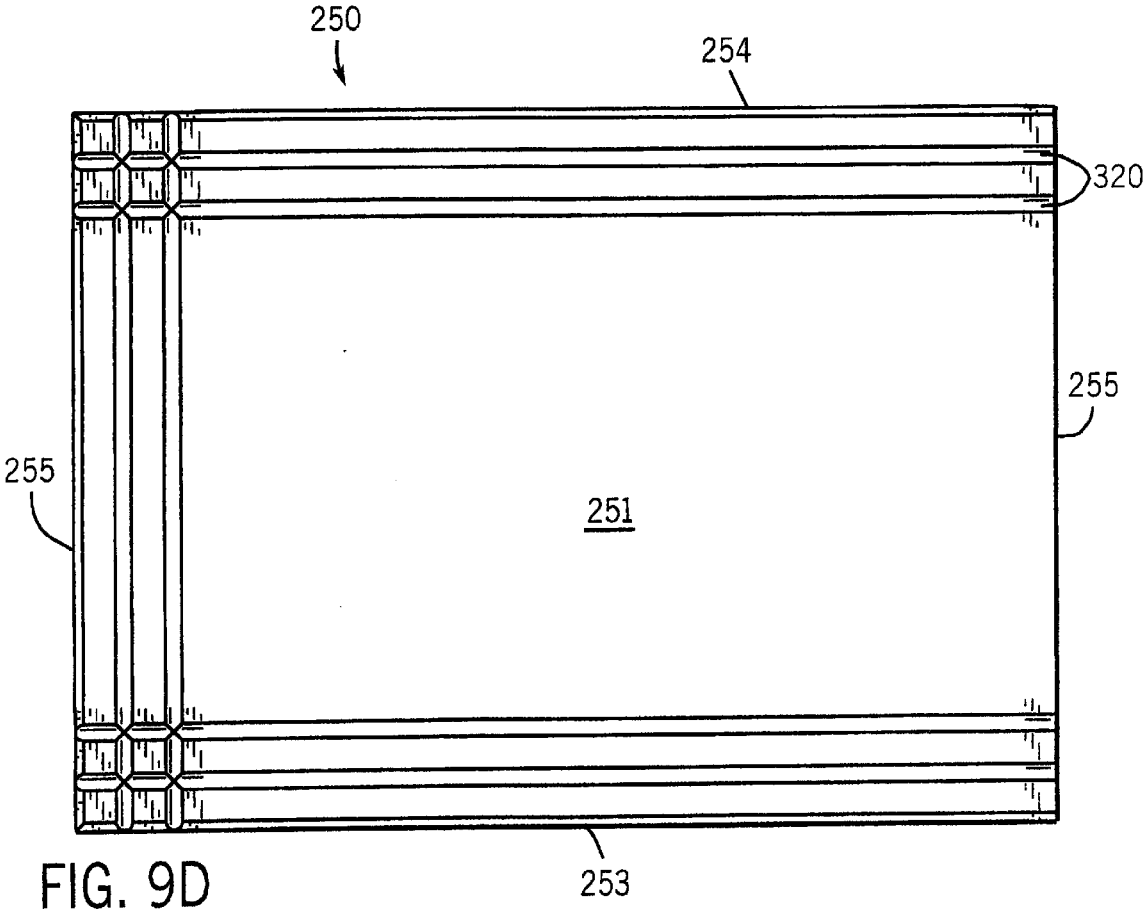
Figure 10A:
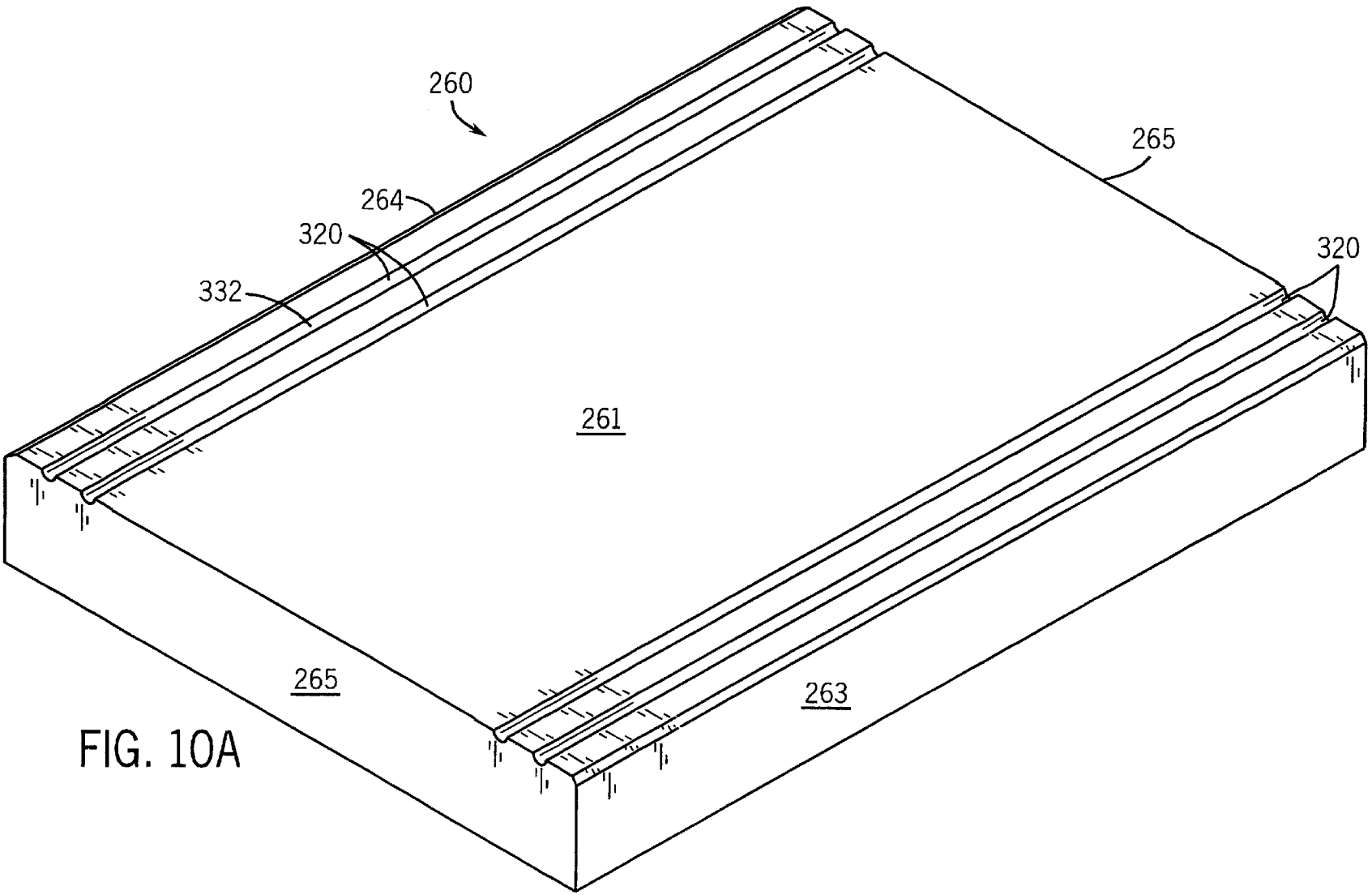
FIGS. 10A–D are perspective, front plan, side plan and top views respectively of a front tread having a pair of parallel grooves formed into its upper surface near two opposed edges.
Figure 10B:
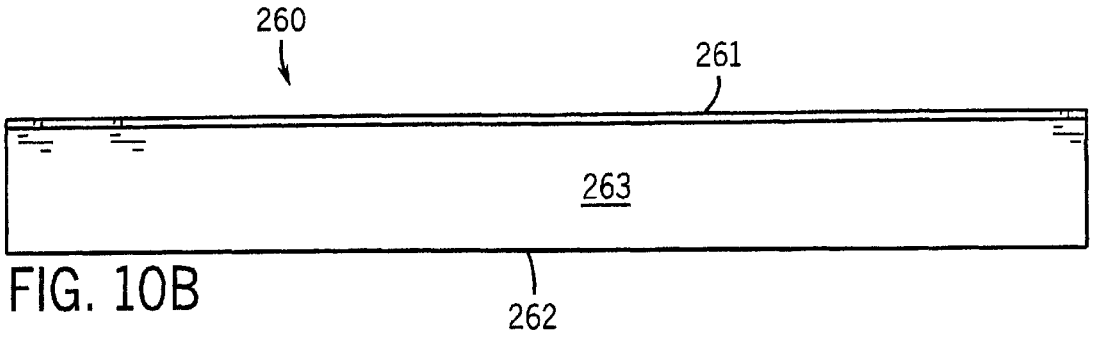
Figure 10C:
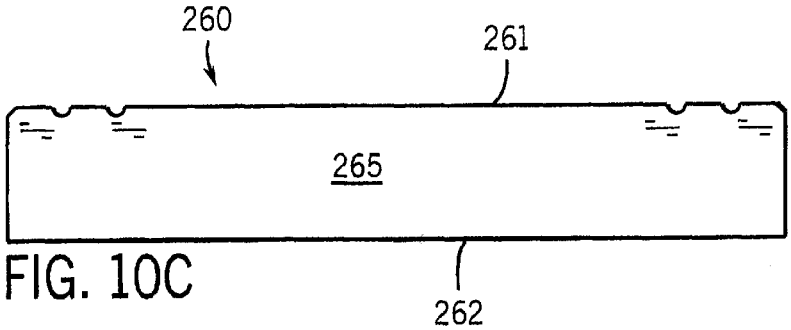
Figure 10D:
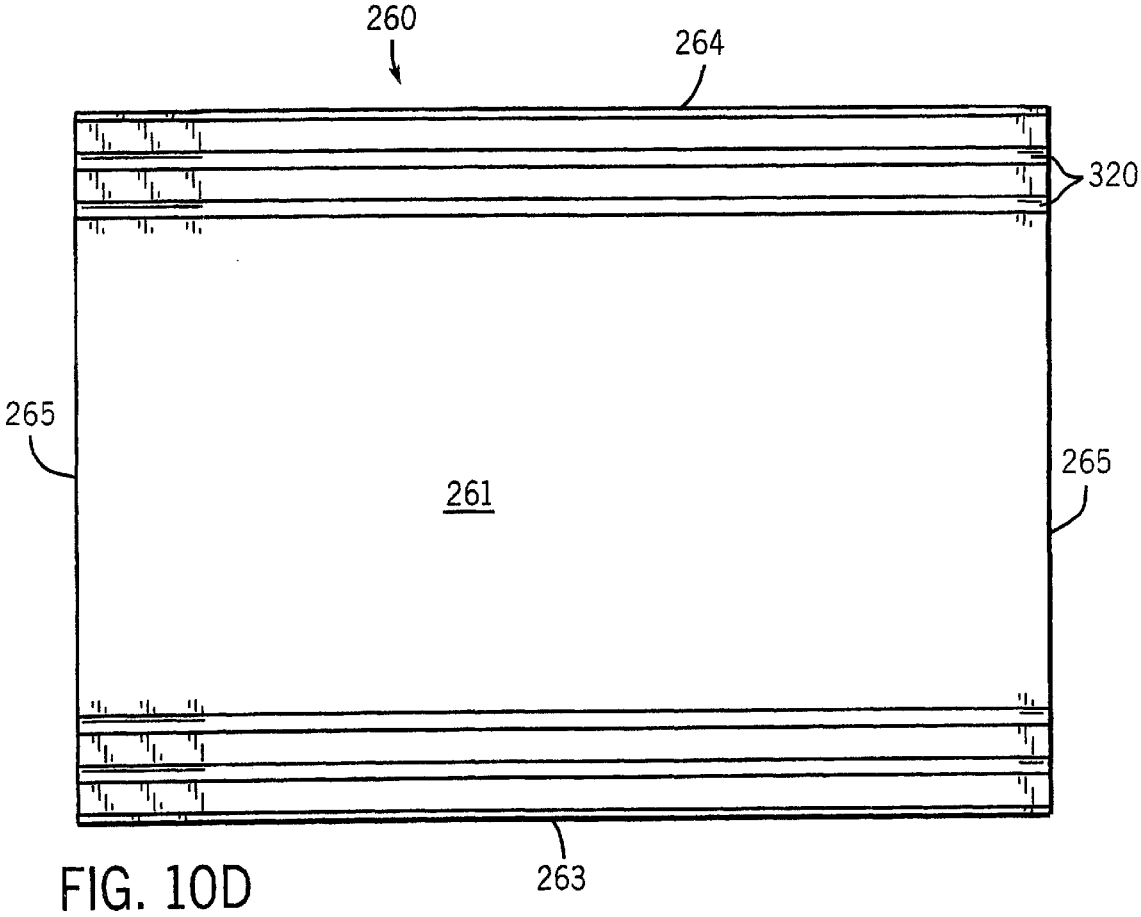
Figure 11A:
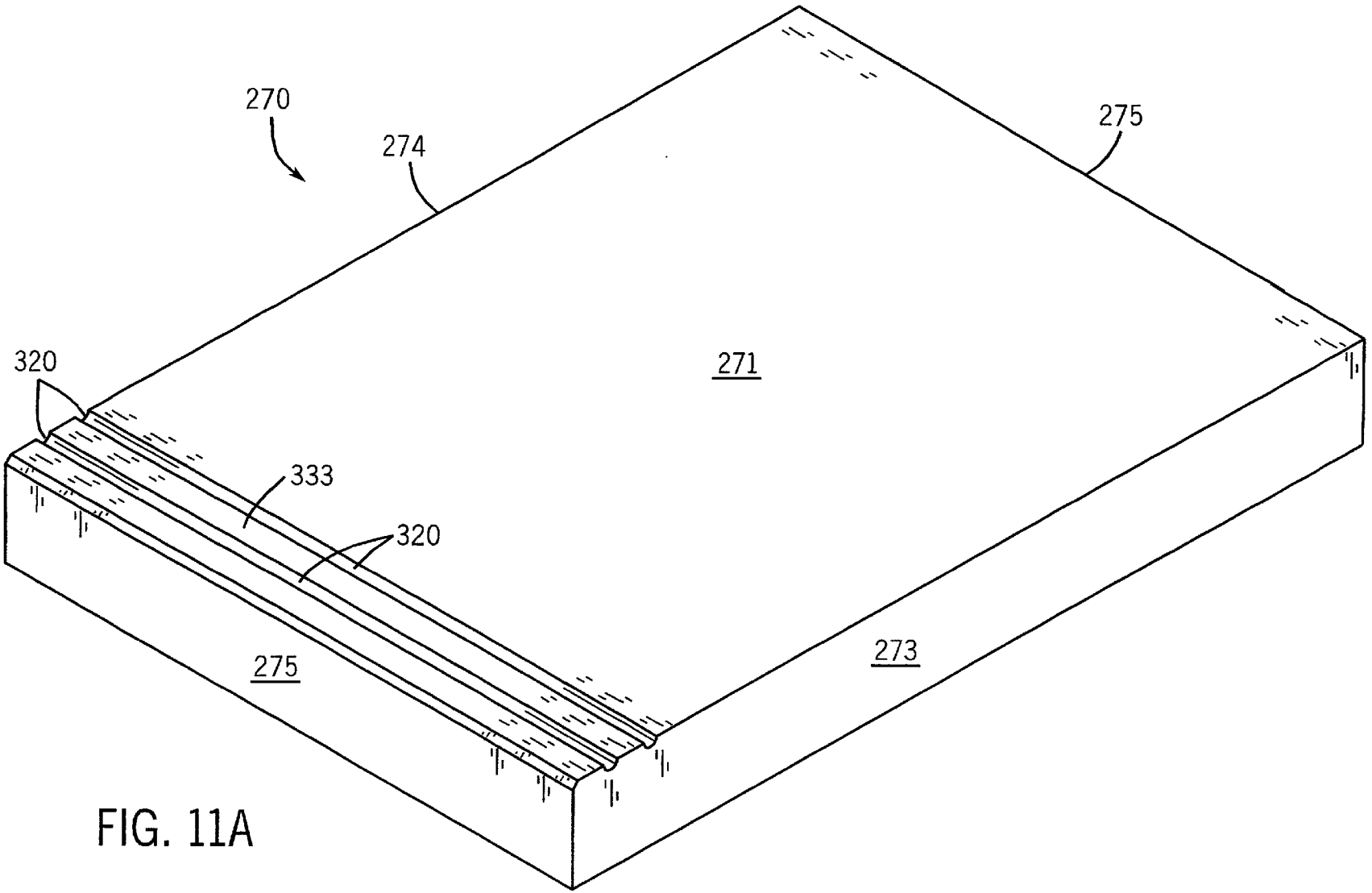
FIGS. 11A–D are perspective, front plan, side plan, and top views respectively of a side tread having a pair of parallel grooves formed into its upper surface near one of its edges.
Figure 11B:
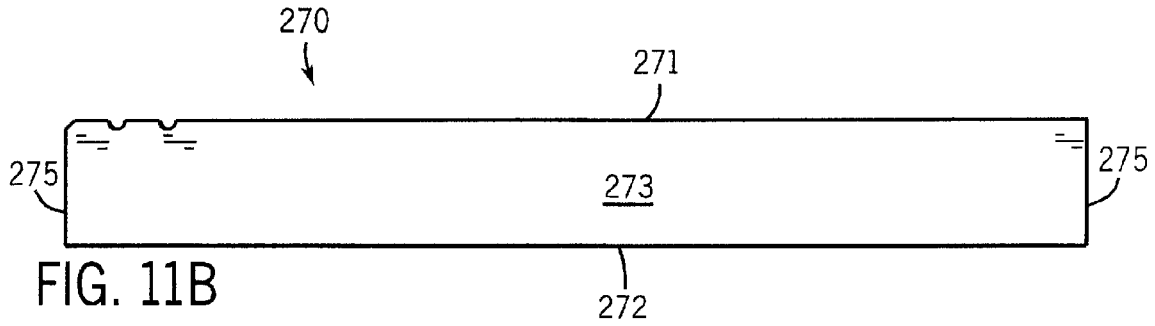
Figure 11C:
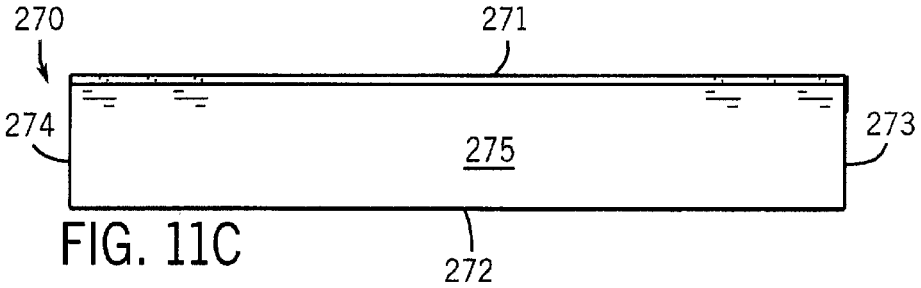
Figure 11D:
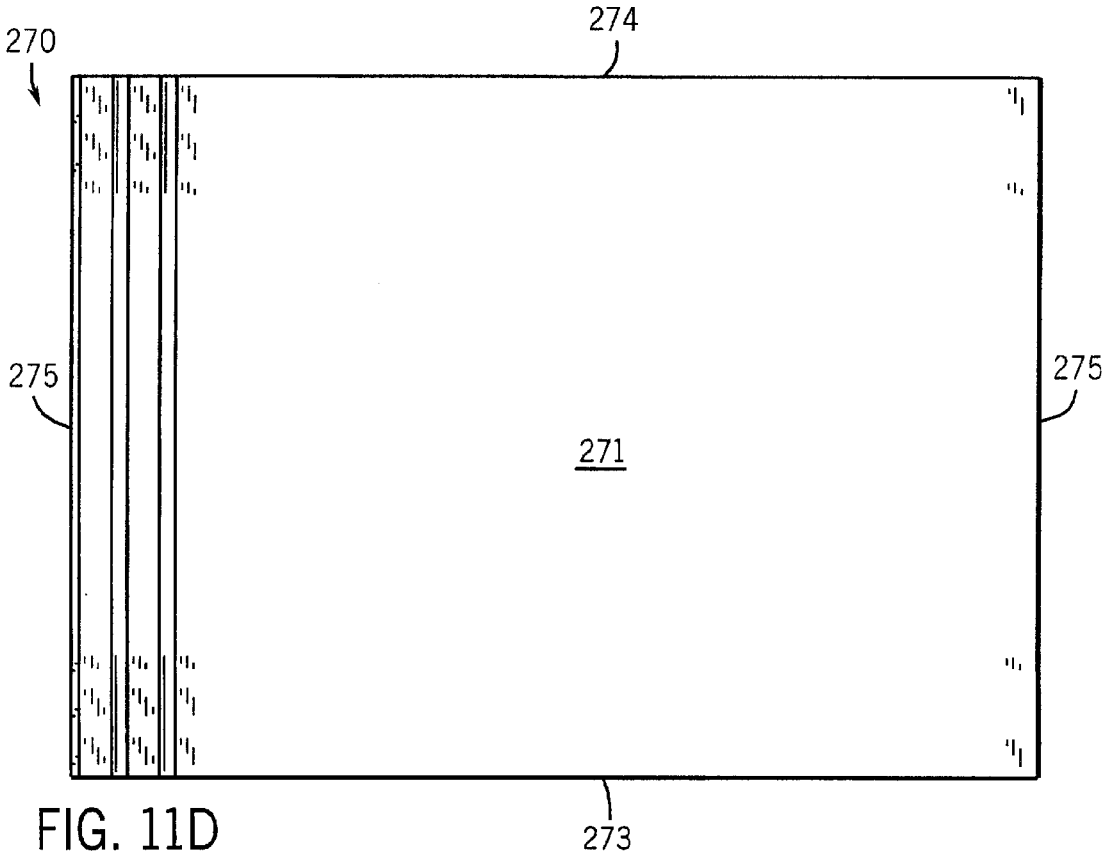
Figure 12:
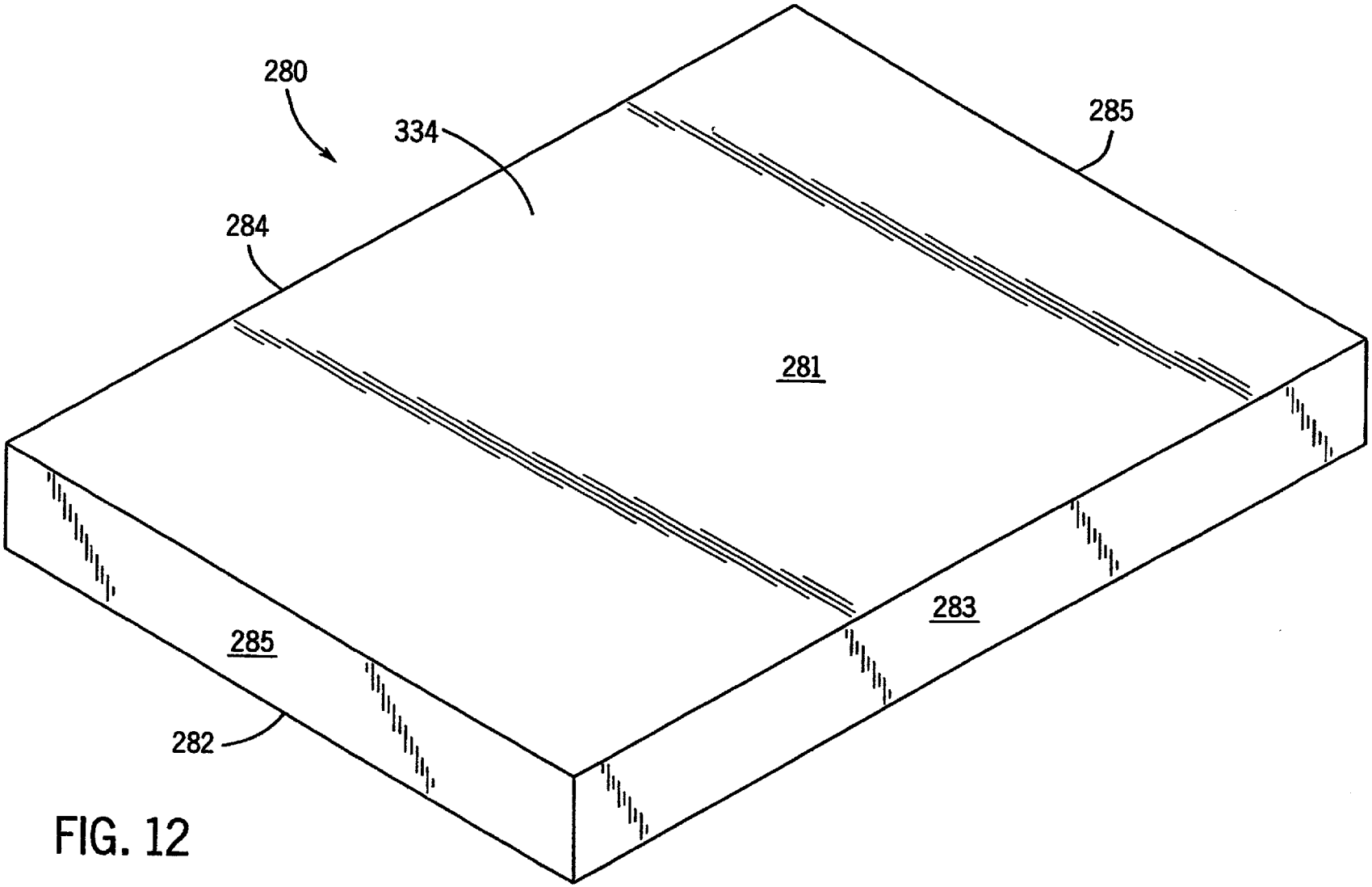
FIG. 12 is perspective view of an inner tread having a smooth surface.
Figure 13A:
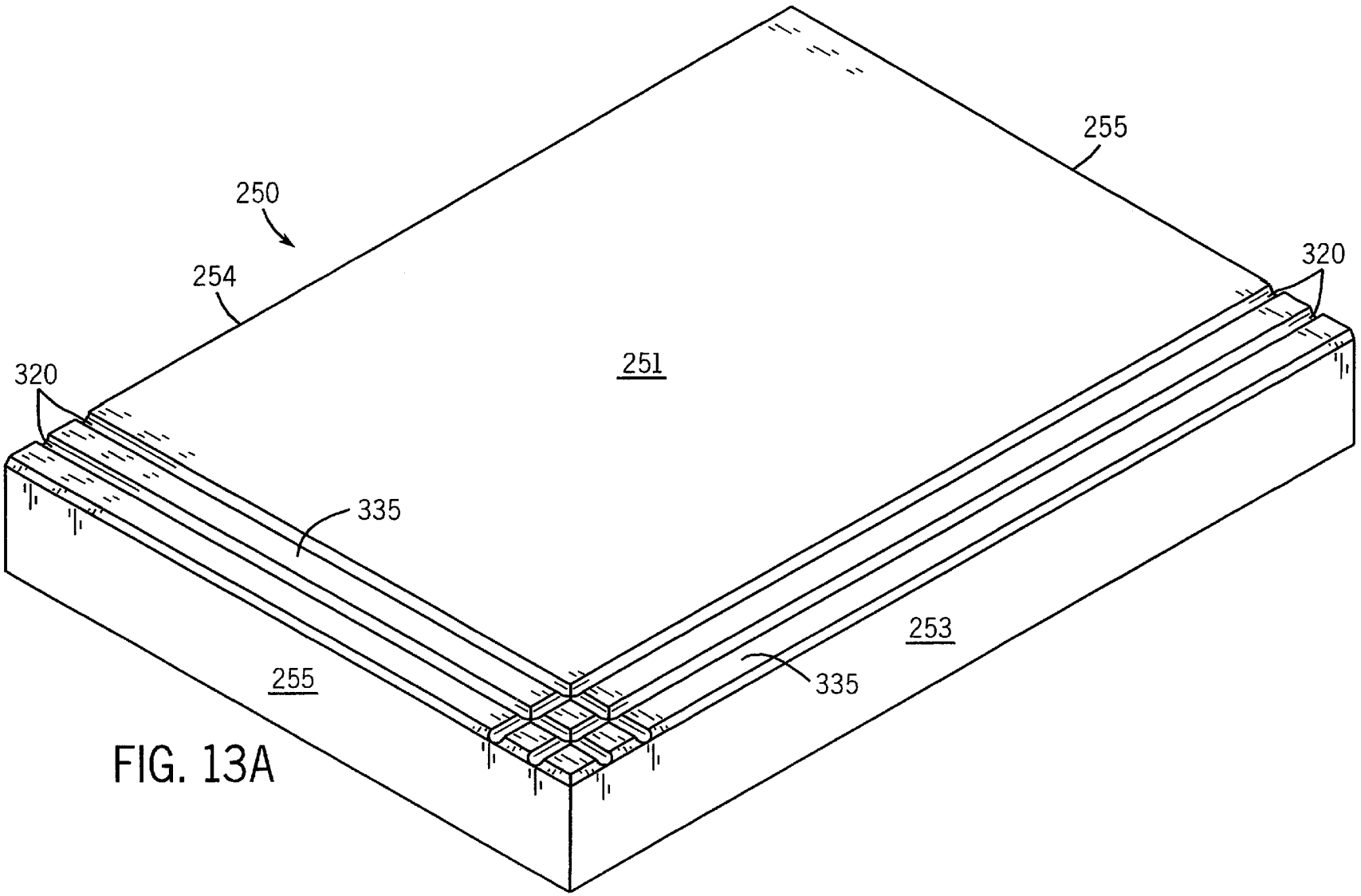
FIGS. 13A–D are perspective, front plan, side plan, and top views respectively of a corner tread having an alternate design with a pair of parallel grooves formed into its upper surface along two of its edges.
Figure 13B:
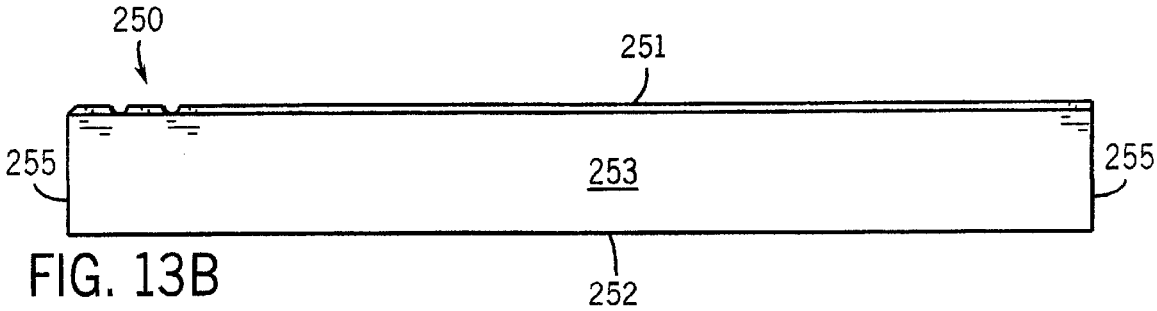
Figure 13C:
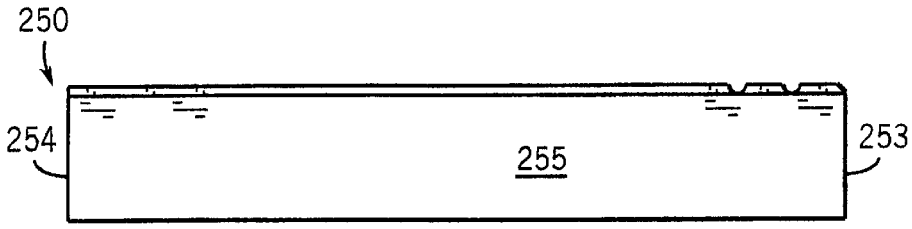
Figure 13D:
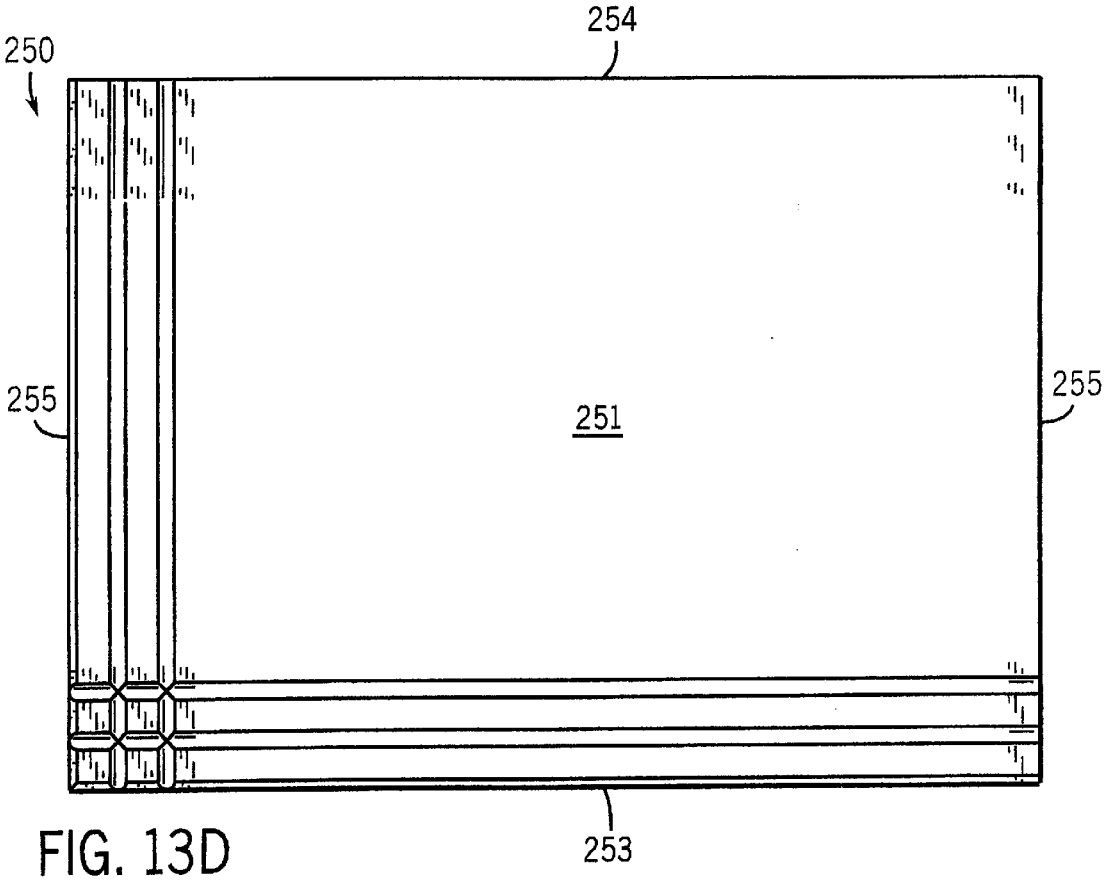

Parallel grooves 320 are formed into the top surfaces 251, 261 and 271 of corner 250, front 260 and side 270 treads. As shown in FIG. 9A, each like-shaped corner tread 250 has three pairs of grooves 320. One pair of grooves is formed along each of its front and rear edges as well as one side edge to produce a first design 331. As shown in FIG. 10A, each like-shaped front tread 260 has two pairs of grooves 320. One pair of grooves is formed along each of its front and rear edges to produce a second design 332. As shown in FIG. 11A, each like-shaped side tread 270 has one pair of grooves 320 formed along one of its side edges to produce a third design 333. As shown in FIG. 12, the like-shaped inner treads have a completely smooth top surface to produce a blank design 334. Alternated designs are possible for the treads 250, 260, 270 and 280. FIGS. 13A–D show a possible alternate design 355 for a corner tread 250. This alternate design would require the removal of one pair of grooves from the front tread 260.

As shown in FIGS. 1 and 14, the individual designs 331, 332, 333 and 334 of the treads 250, 260, 270 and 280 combine to produce a continuous, integral design 340 across the walking surface 32 of the step and deck assembly 30. By shaping and sizing the treads 250, 260, 270 and 280 as noted above, placing the different treads in different predetermined locations such as on corner risers 170, remaining front portions 172, remaining side portions 174 and inner portions 176, and forming the grooves 320 at specific spaced locations from the edges of the treads, a continuous, integral design 340 is produced. The grooves 320 of one tread align integrally with the grooves of adjacent treads to produce the continuous design 340. By placing corner 250 and front 260 treads on the ground 10 in front of the steps 290, the design 340 can be continued down an associated walkway 23.

As shown in FIG. 14, a bed of gravel 360 is spread on the ground in the usable area 15 adjacent the entranceway 8. A sheet 365 of construction grade expanded polystyrene can placed over the gravel 360 to provide a stable, flat base for the placement of the ground tier 152 of risers 50. Risers 50 are then positioned to form the base 31. The weight of the risers is such that they can be lifted and placed in position by hand. Because the assembly 30 incorporates a dry stacked and stacked-bond riser assembly, the number of tiers 150 determines the total height of assembly 30, the number of rows 160 determines its total width, and the number of columns determines the total depth.

Risers 52 are engaged by pairs of locking key slots to rigidly secure adjacent pairs of risers 90 together. Once the risers 52 have been positioned and locked in engagement with each other by keys 201, treads 250, 260, 270 and 280 are adhered to the top surfaces 62 of the risers 50 with an adhesive 350 to complete formation of the step assembly. Preferably, the adhesive should not become rigid upon curing, but should remain somewhat viscous to accommodate for the varying outside temperature conditions that the adhesive will encounter. A preferred adhesive for use in the present invention is a mastic cement, such as that sold under the name "Paverbond". A set of railings 370 may be secured to the assembly by expandable fasteners 371 placed into openings 372 drilled into the treads of the assembly 30.

While the invention has been described with reference to a preferred embodiment, it will be understood by those skilled in the art that various changes may be made and equivalents may be substituted without departing from the broader aspects of the invention.

I claim:

1. A modular masonry step and deck assembly for constructing on the ground adjacent an elevated entrance of a building having a specific usable area and the entrance being a specific height above the ground, said modular masonry step and deck assembly comprising:

a plurality of similar-shaped risers, each riser having substantially planar top and bottom surfaces, and front, rear and opposed side walls with outer surfaces, each outer surface being at substantially a right angle to its two adjacent wall outer surfaces, and each of said risers having uniform height, width and depth dimensions;

a plurality of tiers including a ground tier and a predetermined number of stacked tiers, said stacked tiers including an upper tier, said ground tier including a predetermined number of rows and columns of said risers, each stacked tier being placed atop an immediately lower tier, each tier having a front column and an end row, each of said stacked tiers having one fewer column than and being staggered from said front column of its said immediately lower tier, each of said front columns having a corner riser and a remaining front portion including at least one more of said risers, said end row of said upper tier including said corner riser and a remaining side portion including at least one more of said risers, said upper tier having an interior portion of said risers, said plurality of tiers forming at least one common planar surface adapted for alignment with the building;

a plurality of similar-shaped corner treads, similar-shaped front treads, similar-shaped side treads, and similar-shaped inner treads, each of said treads having a uniform height dimension, substantially planar top and bottom surfaces, and front, rear and opposed side wall surfaces, each of said wall surfaces being at substantially a right angle to its adjacent wall surfaces, each of said corner treads having uniform width and depth dimensions that are greater than said respective width and depth dimensions of said risers, each of said front treads having a uniform width dimension that is equal to said width dimension of said risers and a uniform depth dimension that is equal to said depth dimension of said corner treads, each of said side treads having a uniform width dimension that is equal to said width dimension of said corner treads and a depth dimension that is equal to said depth dimension of said risers, and each of said inner treads having uniform width and depth dimensions that are equal to said respective width and depth dimensions of said risers;

a plurality of steps formed by said front columns and said corner and front treads, one of said corner treads being placed on each of said corner risers, and one of said front treads being placed on each of said risers in said remaining front portions, and said corner and front treads forming a continuous lip around each of said steps;

a deck formed by said side and inner treads, one of said side treads being placed on each of said risers forming said remaining side portions of said upper tier, and one of said inner treads being placed on each of said risers forming said interior portion of said upper tier, said corner, front and side treads forming a continuous lip around said step and deck of said upper tier; and, wherein said number of tiers, rows and columns of said risers are varied to provide a custom fit to the size of the usable areas and height of the entrance of the building.

2. The modular masonry step and deck assembly of claim 1, and wherein said outer wall surfaces of said risers are aligned flush against said outer wall surfaces of its adjacent risers.

3. The modular masonry step and deck assembly of claim 2, and wherein said risers forming said stacked tiers are aligned in a stack-bond alignment with said risers forming said immediately lower tier.

4. The modular masonry step and deck assembly of claim 3, and wherein each of said risers includes a number of vertical grooves formed in its said side walls, each of said grooves having an inwardly expanding cross-sectional area, said grooves being uniformly positioned on each of said risers, said grooves of adjacent risers combining to form a channel, said modular masonry step and deck assembly further including a plurality of locking keys, each of said locking keys having a cross-sectional area with at least two opposed, outwardly expanding fingers, each of said keys being snugly received by one of said channels to join adjacent risers together.

5. The modular masonry step and deck assembly of claim 4, and wherein each of said channels in one of said tiers are aligned with one of said channels in said immediately lower tier to form a continuous channel, and each of said keys extends through one of said continuous channels.

6. The modular masonry step and deck assembly of claim 5, and wherein said side walls of said similar-shaped risers have vertical corners and one of said vertical grooves is located in each of said vertical corners.

7. The modular masonry step and deck assembly of claim 1, and wherein said step and deck assembly has a total height dimension substantially equal to a sum of said height dimensions of said risers for said number of tiers and one of said treads, a total width dimension substantially equal to a sum of said width dimensions of said risers for said number of rows, and a total depth dimension substantially equal to a sum of said depth dimensions of said risers for said number of columns.

8. The modular masonry step and deck assembly of claim 2, and wherein each of said treads has at least two outer wall surfaces in substantially parallel alignment with at least two outer wall surfaces of its said respective riser on which it is placed.

9. The modular masonry step and deck assembly of claim 1, and wherein each of said similar-shaped risers has a hollow interior defined by front, rear and opposed side walls, one of said walls has a notch protruding downward from said top surface of said riser and extending from its said outer surface to said interior, said notch being adapted to hold a light fixture.

10. The modular masonry step and deck assembly claim 1, and where said common planar surface is a surface is a surface opposite said steps.

11. A modular masonry step and deck assembly for constructing on the ground adjacent an elevated entrance of a building having a specific usable area and the entrance being a specific height above the ground, said modular masonry step and deck assembly comprising:

a plurality of similar-shaped risers, each riser having substantially planar top and bottom surfaces, and front, rear and opposed side walls with outer surfaces, each outer surface being at substantially a right angle to its two adjacent wall outer surfaces, each of said risers including a plurality of vertical grooves formed in its said side walls, each of said grooves having an inwardly expanding cross-sectional area, said grooves being uniformly positioned on each of said risers;

a unitary base having a plurality of tiers including a ground tier and a predetermined number of stacked tiers, said stacked tiers including an upper tier, each tier being formed by a plurality of adjacent risers, said outer wall surfaces of said adjacent risers being flushly aligned, said ground tier including a predetermined number of rows and columns of said risers, each riser being dry stacked in a stacked-bond arrangement with one of said risers in an immediately lower tier, each tier having a front column and end rows, each of said stacked tiers having one fewer column than and being staggered from said front column of its said immediately lower tier, said grooves of adjacent risers combining to form a channel, each of said channels in one of said tiers being aligned with one of said channels in said immediately lower tier to form a continuous channel;

a plurality of locking keys, each of said locking keys having a cross-sectional area with at least two opposed, outwardly expanding fingers, each of said keys being snugly received by one of said continuous channels to join adjacent risers together to form said unitary base;

a plurality of treads for forming a walking surface including a plurality of steps and a deck, each tread being secured to one of said risers, each of said steps and said deck being formed by said treads placed on each of said risers forming said upper tier and each of said front columns of said remaining stacked tiers and said ground tier; and, wherein said number of tiers, rows and columns of said risers are varied to provide a custom fit to the usable areas and entrance height of the building.

12. A semi-flexible base assembly for constructing a step and deck over an area of ground, the semi-flexible base comprising:

a plurality of risers having top and bottom surfaces and side wall surfaces, said risers being placed in flush engagement with each other to form a plurality of rows and columns, said risers being stacked one atop an other to form a plurality of tiers, said side wall surfaces having a vertical groove, said vertical groove having an inwardly expanding cross-sectional shape, said grooves of adjacent risers being aligned to form a channel, said adjacent risers being stacked in a stacked-bond arrangement atop of adjacent risers of an immediately lower tier, said adjacent risers forming a channel, said channels being in linear alignment to form a continuous channel extending from tier to tier; and, a plurality of semi-flexible, elongated keys, each of said keys having an plurality of fingers, each of said fingers having an outwardly expanding cross-sectional shape, each of said elongated keys substantially filling one of said channels formed by said adjacent and stacked risers, said semi-flexible keys allowing said masonry risers to move relative to each other to accommodate movements in the ground caused by freezing and thawing.

13. A masonry riser for a step and deck assembly, said masonry riser comprising:

a main body having substantially parallel top and bottom surfaces, and front, rear and opposed side wall surfaces that define an outer margins of said riser, each wall surface being at substantially a right angle to its two adjacent wall surfaces, said adjacent wall surfaces forming a vertical corner of said riser, and said wall surfaces having uniform height, width and depth dimensions; and, a plurality of vertical grooves formed in said side wall surfaces, each of said vertical grooves being located in each of said corners and spanning from said top surface to said bottom surface, each of said grooves having an inwardly expanding cross-sectional area with a narrow neck and a wider interior portion.

14. The masonry riser of claim 13, and wherein said riser has front, rear and opposed side walls that form a hollow interior.

15. The masonry riser of claim 14, and wherein said groove is formed by a continuous arcuate wall.

16. The masonry riser of claim 14, and wherein one of said walls has a notch formed in said top surface of said riser, said notch extending from one of said wall surfaces to said interior, said notch being adapted to hold a light fixture.

* * * * *